US009874082B2

(12) United States Patent
Tjhang et al.

(10) Patent No.: US 9,874,082 B2
(45) Date of Patent: Jan. 23, 2018

(54) DOWNHOLE IMAGING SYSTEMS AND METHODS

(71) Applicants: Schlumberger Technology Corporation, Sugar Land, TX (US); The University of Tokyo, Bunkyo-ku (JP)

(72) Inventors: Theodorus Tjhang, Sagamihara (JP); Bonnie Powell, Western Australia (AU); Yutaka Imasato, Chiba (JP); Yoshihiro Watanabe, Katsushika-ku (JP); Masatoshi Ishikawa, Kashiwa (JP)

(73) Assignees: SCHLUMBERGER TECHNOLOGY CORPORATION, Sugar Land, TX (US); THE UNIVERSITY OF TOKYO, Tokyo (JP)

( * ) Notice: Subject to any disclaimer, the term of this patent is extended or adjusted under 35 U.S.C. 154(b) by 252 days.

(21) Appl. No.: 14/109,729

(22) Filed: Dec. 17, 2013

(65) Prior Publication Data

US 2015/0167447 A1 Jun. 18, 2015

(51) Int. Cl.

| | |
|---|---|
| ***E21B 47/00*** | (2012.01) |
| ***E21B 47/12*** | (2012.01) |
| ***E21B 47/18*** | (2012.01) |
| *H04N 7/18* | (2006.01) |

(52) U.S. Cl.

CPC ..... *E21B 47/0002* (2013.01); *E21B 47/12* (2013.01); *E21B 47/18* (2013.01)

(58) Field of Classification Search

CPC ..... E21B 47/0002; H04N 7/185; H04N 2005/2255; G03B 37/005; F02K 9/24

See application file for complete search history.

(56) References Cited

U.S. PATENT DOCUMENTS

| | | | | |
|---|---|---|---|---|
| 4,657,387 A * | 4/1987 | Heising | ..... | E21B 47/0002 356/241.1 |
| 4,817,059 A * | 3/1989 | Hornby | ..... | G01V 1/50 367/25 |
| 5,457,995 A * | 10/1995 | Staton | ..... | E21B 29/00 73/40.5 A |
| 6,269,310 B1 * | 7/2001 | Washbourne | ..... | G01V 1/42 702/17 |

(Continued)

OTHER PUBLICATIONS

Watanabe, et al., "955-fps Real-time Shape Measurement of a Moving/Deforming Object using High-speed Vision for Numerous-point Analysis", 2007 IEEE International Conference on Robotics and Automation, Roma, Italy, Apr. 10-14, 2007.

*Primary Examiner* — Sath V Perungavoor
*Assistant Examiner* — Howard D Brown, Jr.
(74) *Attorney, Agent, or Firm* — Trevor G. Grove

(57) ABSTRACT

Downhole imaging systems and methods are disclosed herein. An example method includes projecting flushing fluid into an optical field of view of an imaging system disposed on a downhole tool. The example method also includes directing a pattern of light onto a target in the optical field of view via a light source of the imaging system and determining three-dimensional shape information of the target based on the light directed from the target and received via an image detection plane of the imaging system. The example method further includes determining a characteristic of the target based on the three-dimensional shape information.

19 Claims, 14 Drawing Sheets

(56) References Cited

U.S. PATENT DOCUMENTS 7,027,066 B2 * 4/2006 Ohmori ..... G09G 5/363 345/519
7,114,562 B2 * 10/2006 Fisseler ..... E21B 17/078 166/100
8,664,587 B2 * 3/2014 Evans ..... G01V 5/104 250/269.4
9,217,797 B2 12/2015 Tulett et al.
2004/0177681 A1 * 9/2004 Harthorn ..... E21B 17/01 73/152.57
2004/0204855 A1 * 10/2004 Fleury ..... E21B 47/0002 702/6
2005/0194132 A1 * 9/2005 Dudley ..... E21B 47/00 166/254.1
2007/0035736 A1 * 2/2007 Vannuffelen ..... E21B 49/08 356/432
2007/0289740 A1 * 12/2007 Thigpen ..... E21B 37/06 166/250.01
2009/0167297 A1 * 7/2009 Chee ..... E21B 47/0905 324/221
2010/0200743 A1 * 8/2010 Forster ..... E21B 47/02208 250/254
2010/0282510 A1 * 11/2010 Sullivan ..... E21B 10/00 175/40
2012/0111560 A1 * 5/2012 Hill ..... E21B 43/11857 166/250.1
2012/0169841 A1 * 7/2012 Chemali ..... E21B 47/0002 348/36
2012/0188090 A1 * 7/2012 Wessling ..... E21B 47/0002 340/853.1
2013/0239673 A1 * 9/2013 Garcia-Osuna ..... E21B 17/16 73/152.46
2013/0265409 A1 * 10/2013 Tjhang ..... H04N 5/23206 348/82

* cited by examiner

DOWNHOLE IMAGING SYSTEMS AND METHODS

BACKGROUND

Imaging systems employed on downhole tools generally generate large amounts of data, which cannot be communicated in real-time through low bandwidth telemetry systems such as, for example, mud pulse telemetry systems. Further, the optical fields of view of imaging systems employed on downhole tools are often obstructed by opaque fluids and debris.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An example method disclosed herein includes projecting flushing fluid into an optical field of view of an imaging system disposed on a downhole tool. The example method also includes directing a pattern of light onto a target in the optical field of view via a light source of the imaging system and determining three-dimensional shape information of the target based on the light directed from the target and received via an image detection plane of the imaging system. The example method further includes determining a characteristic of the target based on the three-dimensional shape information.

Another example method includes projecting flushing fluid from a downhole tool into a field of view of an imaging system disposed on the downhole tool. The imaging system includes a light source and an image detection plane. The example method also includes determining three-dimensional shape information of a target via a processor of the imaging system based on a first pattern of light directed onto the target via the light source and a second pattern of light received by the image detection plane. The example method further includes generating an image based on the three-dimensional shape information and controlling the downhole tool based on the image.

Another example method includes determining three-dimensional shape information of a target via an imaging system and determining shape characteristic data of the target based on the three-dimensional shape information. The example method also includes matching the shape characteristic data with first predetermined target data stored in a first database and determining a database index associated with the first predetermined target data. The example method further includes retrieving second predetermined target information from a second database using the database index.

Figure 1:
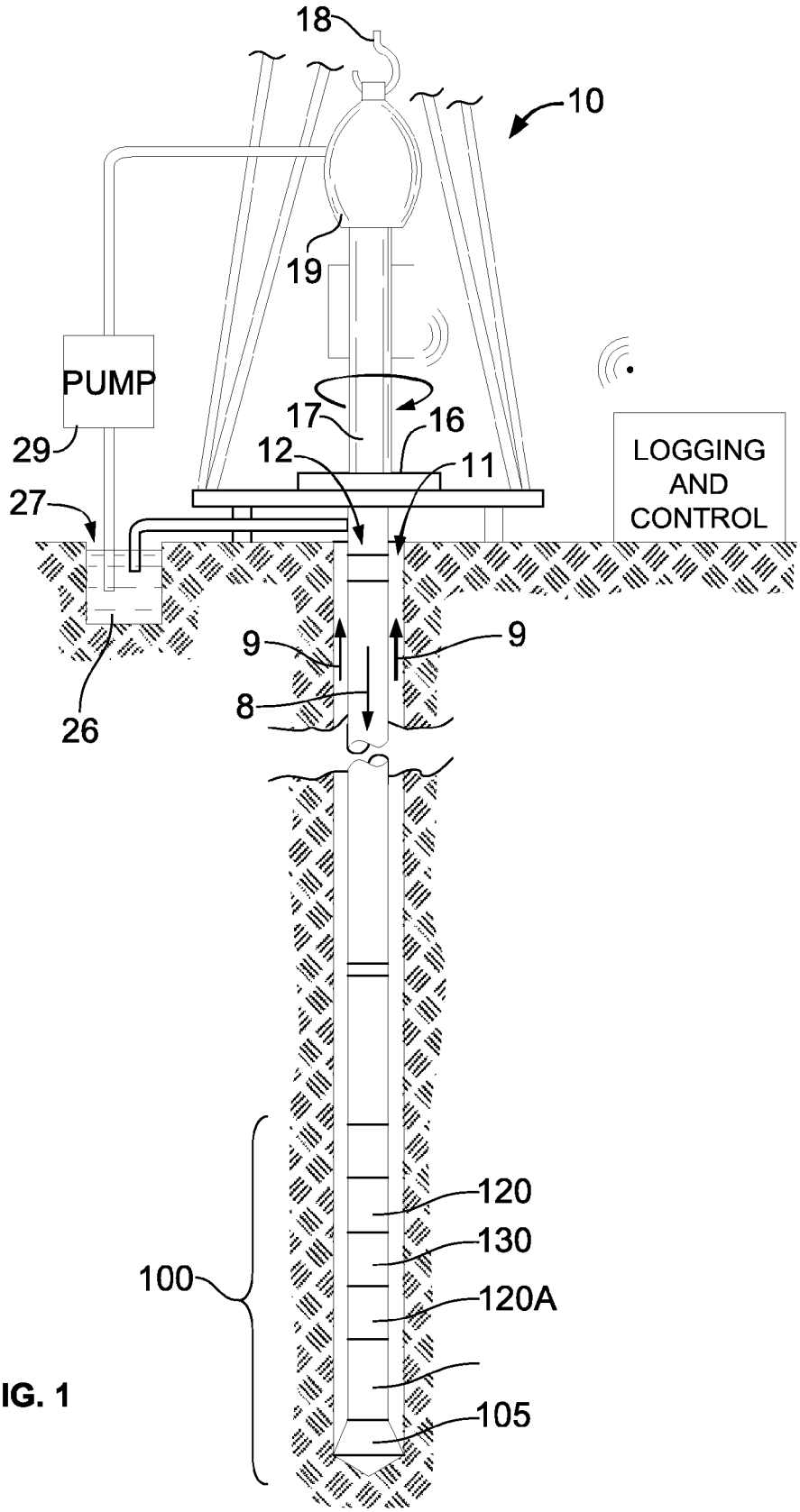
FIG. 1 illustrates an example system in which embodiments of downhole imaging systems and methods can be implemented.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part (e.g., a layer, film, area, or plate) is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

Downhole imaging systems and methods are disclosed herein. An example imaging system disclosed herein includes a light source, an image sensor, and an image processor. In some examples, the light source directs a pattern of light such as, for example, an array of spots, onto a target. The target may be, for example, a casing, a borehole wall, and/or any other object(s) and/or area(s). Light is directed (e.g., reflected) from the target based on a shape of the target. For example, some of the light directed from the target may be received via the image sensor and some of the light may be directed away from the image sensor and, thus, not received via the image sensor. In some examples, the image sensor includes an image detection plane having a plurality of photo detectors disposed on a plane. In some examples, the image processor determines where on the image sensor the light is received and determines a plurality a measurements based on where the light is received relative to where the light source directed the pattern of light. The example image processor may generate an image based on the measurements and/or determine a characteristic of the target such as, for example, texture, shape, size, position, etc.

In some examples, the imaging system retrieves first predetermined target information from a first database based on the three-dimensional shape information. For example, the image processor may associate (e.g., match) the three-dimensional shape information and/or the characteristic of the target with the first predetermined target information using spatial correlation. In some examples, a database index is assigned to and/or associated with the first predetermined target information, and the imaging system communicates in real-time the database index to a surface system employing a second database. In some examples, the second database employs an organizational structure similar or identical to the first database, and the second database includes second predetermined target information assigned and/or associated with the database index. In some examples, the surface system retrieves the second predetermined target information, which may include a variety of information related to the target and/or similar targets. The second predetermined target information may be logged and/or displayed to an operator of a downhole tool including the example imaging system. Thus, the example imaging system enables communication of a small amount of information (e.g., database indexes) uphole while enabling monitoring and/or detection of downhole targets in real-time.

For example, the imaging system may determine texture data of a downhole target and match the texture data to predetermined texture data stored in the first database. The example imaging system may then determine a database index associated with the predetermined texture data and communicate in real-time the database index to the surface system. When the surface system receives the database index, the surface system may retrieve a composition of a subterranean formation from the second database associated with the database index. The composition of the subterranean formation may be logged with a depth of the downhole tool when the database index was received to generate a map and/or facilitate navigation of a borehole.

In some examples, the three-dimensional shape information determined via the imaging system is used to control a downhole tool. For example, the imaging system may determine three-dimensional shape information and/or generate images of a borehole wall as the downhole tool is lowered in a multilateral well. When the downhole tool moves past a borehole window (e.g., an opening from a first borehole to a second borehole in the multilateral well), the example imaging system may be used to detect the window. For example, three-dimensional shape information may be communicated to the surface system, and images of the window may be presented to an operator of the downhole tool. The operator may use images to align the downhole tool with the window and move the downhole tool from the first borehole into the second borehole.

FIG. 1 illustrates a wellsite system in which examples disclosed herein can be employed. The wellsite can be onshore or offshore. In this example system, a borehole 11 is formed in subsurface formations by rotary drilling in a manner that is well known. Other examples can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the derrick assembly 10 including a rotary table 16, a kelly 17, a hook 18 and a rotary swivel 19. The drill string 12 is rotated by the rotary table 16, energized by means not shown, which engages the kelly 17 at an upper end of the drill string 12. The drill string 12 is suspended from the hook 18, attached to a traveling block (also not shown), through the kelly 17 and the rotary swivel 19, which permits rotation of the drill string 12 relative to the hook 18. In some examples, a top drive system can be used.

In the illustrated example, the surface system further includes drilling fluid or mud 26 stored in a pit 27 formed at the well site. A pump 29 delivers the drilling fluid 26 to the interior of the drill string 12 via a port in the swivel 19, causing the drilling fluid 26 to flow downwardly through the drill string 12 as indicated by directional arrow 8. The drilling fluid 26 exits the drill string 12 via ports in the drill bit 105, and then circulates upwardly through the annulus region between the outside of the drill string 12 and the wall of the borehole 11, as indicated by directional arrows 9. In this manner, the drilling fluid 26 lubricates the drill bit 105 and carries formation cuttings up to the surface as it is returned to the pit 27 for recirculation.

The bottom hole assembly 100 of the illustrated example includes a logging-while-drilling (LWD) module 120, a measuring-while-drilling (MWD) module 130, a roto-steerable system and motor, and the drill bit 105.

The LWD module 120 is housed in a special type of drill collar, as is known in the art, and can contain one or more logging tools. It will also be understood that more than one LWD and/or MWD module can be employed, for example, as represented at 120A. References throughout to a module at the position of module 120 can mean a module at the position of module 120A. The LWD module 120 includes capabilities for measuring, processing, and storing information, as well as for communicating with the surface equipment. In the illustrated example, the LWD module 120 includes a fluid sampling device.

The MWD module 130 is also housed in a special type of drill collar, as is known in the art, and can contain one or more devices for measuring characteristics of the drill string 12 and the drill bit 105. The MWD module 130 further includes an apparatus (not shown) for generating electrical power to the downhole system. This may include a mud turbine generator powered by the flow of the drilling fluid 26, and/or other power and/or battery systems. In the illustrated example, the MWD module 130 includes one or more of the following types of measuring devices: a weight-on-bit measuring device, a torque measuring device, a vibration measuring device, a shock measuring device, a stick slip measuring device, a direction measuring device, and an inclination measuring device.

Figure 2:
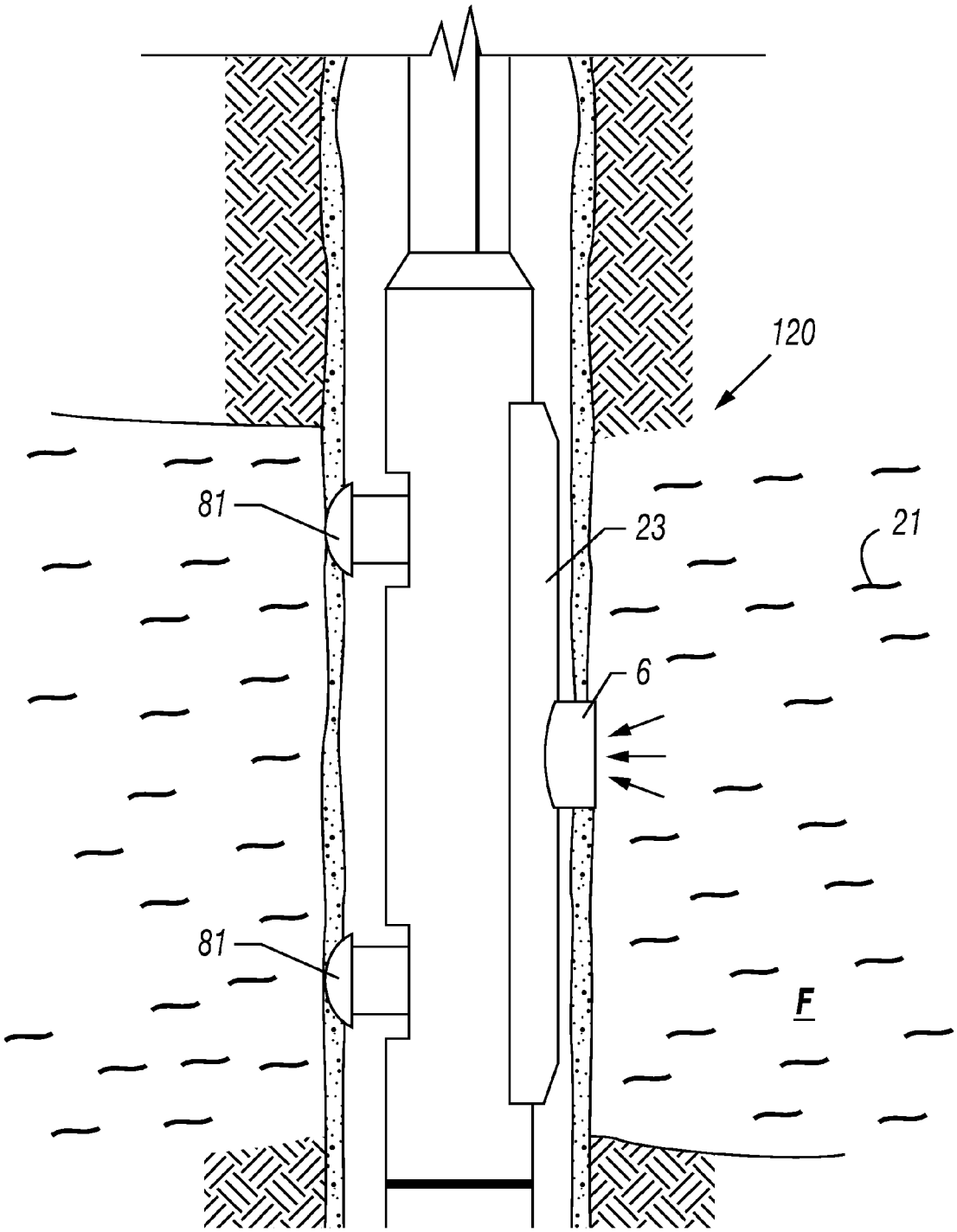
FIG. 2 illustrates another example system in which embodiments of downhole imaging systems and methods can be implemented.

FIG. 2 is a simplified diagram of a sampling-while-drilling logging device of a type described in U.S. Pat. No. 7,114,562, incorporated herein by reference, utilized as the LWD tool 120 or part of the LWD tool suite 120A. The LWD tool 120 is provided with a probe 6 for establishing fluid communication with the formation and drawing fluid 21 into the tool 120, as indicated by the arrows. The probe 6 may be positioned in a stabilizer blade 23 of the LWD tool 120 and extended therefrom to engage a borehole wall. The stabilizer blade 23 comprises one or more blades that are in contact with the borehole wall. The fluid 21 drawn into the tool 120 using the probe 6 may be measured to determine, for example, pretest and/or pressure parameters and/or properties and/or characteristics of the fluid 21. The LWD tool 120 may be provided with devices, such as sample chambers, for collecting fluid samples for retrieval at the surface. Backup pistons 81 may also be provided to assist in applying force to push the drilling tool and/or probe 6 against the borehole wall.

Figure 3:
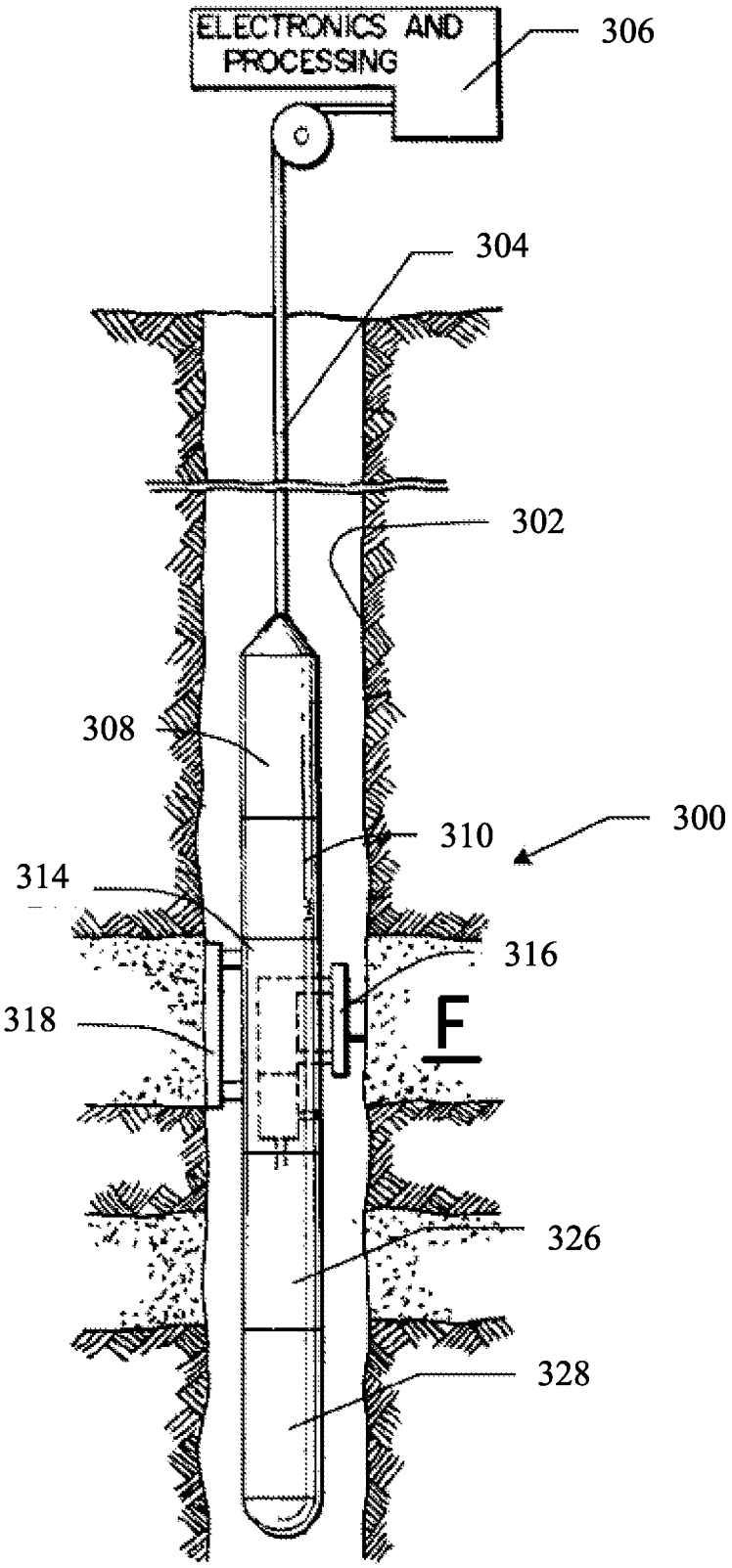
FIG. 3 illustrates another example system in which embodiments of downhole imaging systems and methods can be implemented.

FIG. 3 illustrates an example wireline tool 300 that may be another environment in which aspects of the present disclosure may be implemented. The example wireline tool 300 is suspended in a wellbore 302 from a lower end of a multiconductor cable 304 that is spooled on a winch (not shown) at the Earth's surface. At the surface, the cable 304 is communicatively coupled to an electronics and processing system 306. The example wireline tool 300 includes an elongated body 308 that includes a formation tester 314 having a selectively extendable probe assembly 316 and a selectively extendable tool anchoring member 318 that are arranged on opposite sides of the elongated body 308. Additional components (e.g., 310) may also be included in the tool 300.

The example extendable probe assembly 316 is configured to selectively seal off or isolate selected portions of the wall of the wellbore 302 to fluidly couple to an adjacent formation F and/or to draw fluid samples from the formation F. The extendable probe assembly 316 may be provided with a probe having an embedded plate. Formation fluid may be expelled through a port (not shown) or it may be sent to one or more fluid collecting chambers 326 and 328. In the illustrated example, the electronics and processing system 306 and/or a downhole control system are configured to control the extendable probe assembly 316 and/or the drawing of a fluid sample from the formation F.

Figure 4:
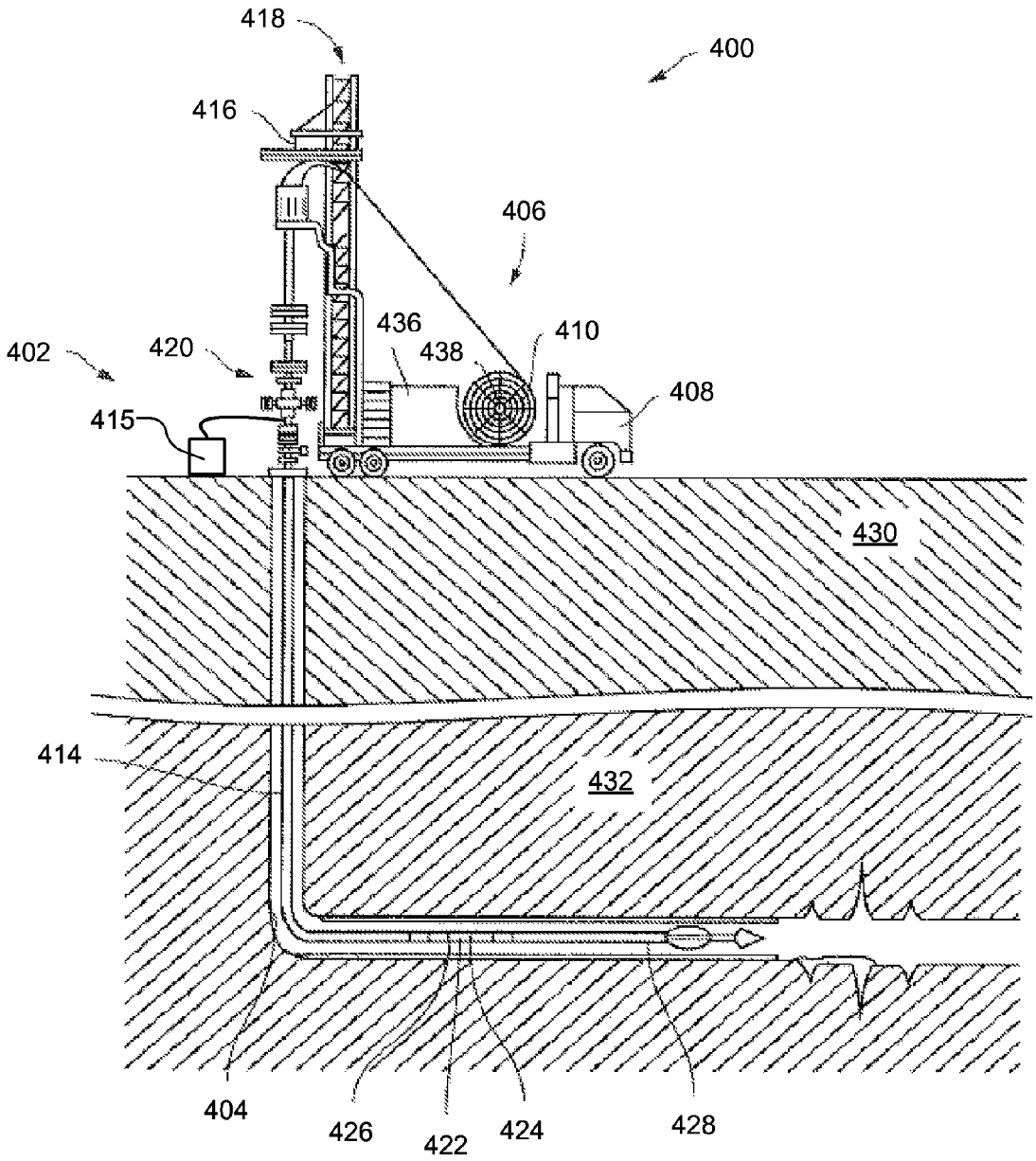
FIG. 4 illustrates another example system in which embodiments of downhole imaging systems and methods can be implemented.

FIG. 4 is a schematic depiction of a wellsite 400 with a coiled tubing system 402 in which aspects of the present disclosure can be implemented. The example coiled tubing system 402 of FIG. 4 is deployed into a well 404. The coiled tubing system 402 includes surface delivery equipment 406, including a coiled tubing truck 408 with a reel 410, positioned adjacent the well 404 at the wellsite 400. The coiled tubing system 402 also includes coiled tubing 414. In some examples, a pump 415 is used to pump a fluid into the well 404 via the coiled tubing. With the coiled tubing 414 run through a conventional gooseneck injector 416 supported by a mast 418 over the well 404, the coiled tubing 414 may be advanced into the well 404. That is, the coiled tubing 414 may be forced down through valving and pressure control equipment 420 and into the well 404. In the coiled tubing system 402 as shown, a treatment device 422 is provided for delivering fluids downhole during a treatment application. The treatment device 422 is deployable into the well 404 to carry fluids, such as an acidizing agent or other treatment fluid, and disperse the fluids through at least one injection port 424 of the treatment device 422.

The coiled tubing system 402 of FIG. 4 includes a fluid sensing system 426. In some examples, the coiled tubing system 402 includes a logging tool 428 for collecting downhole data. The logging tool 428 as shown is provided near a downhole end of the coiled tubing 414. The logging tool 428 acquires a variety of logging data from the well 404 and surrounding formation layers 430, 432 such as those depicted in FIG. 4. The logging tool 428 is provided with a host of well profile generating equipment or implements configured for production logging to acquire well fluids and formation measurements from which an overall production profile may be developed. Other logging, data acquisition, monitoring, imaging and/or other devices and/or capabilities may be provided to acquire data relative to a variety of well characteristics. Information gathered may be acquired at the surface in a high speed manner and put to immediate real-time use (e.g. via a treatment application), movement of the coiled tubing 414, etc.

With reference still to FIG. 4, the coiled tubing 414 with the treatment device 422, the fluid sensing system 426 and the logging tool 428 thereon is deployed downhole. As these components are deployed, treatment, sensing and/or logging applications may be directed by way of a control unit 436 at the surface. For example, the treatment device 422 may be activated to release fluid from the injection port 424; the fluid sensing system 426 may be activated to collect fluid measurements; and/or the logging tool 428 may be activated to log downhole data, as desired. The treatment device 422, the fluid sensing system 426 and the logging tool 428 are in communication with the control unit 436 via a communication link, which conveys signals (e.g., power, communication, control, etc.) therebetween. In some examples, the communication link is located in the logging tool 428 and/or any other suitable location. The communication link may be a hardwire link, an optical link, a mud pulse telemetry link, and/or any other communication link.

In the illustrated example, the control unit 436 is computerized equipment secured to the truck 408. However, the control unit 436 may be portable computerized equipment such as, for example, a smartphone, a laptop computer, etc. Additionally, powered controlling of the application may be hydraulic, pneumatic and/or electrical. In some examples, the control unit 436 controls the operation, even in circumstances where subsequent different application assemblies are deployed downhole. That is, subsequent mobilization of control equipment may not be included.

The control unit 436 may be configured to wirelessly communicate with a transceiver hub 438 of the coiled tubing reel 410. The receiver hub 438 is configured for communication onsite (surface and/or downhole) and/or offsite as desired. In some examples, the control unit 436 communicates with the sensing system 426 and/or logging tool 428 for conveying data therebetween. The control unit 436 may be provided with and/or coupled to databases, processors, and/or communicators for collecting, storing, analyzing, and/or processing data collected from the sensing system and/or logging tool.

Figure 5:
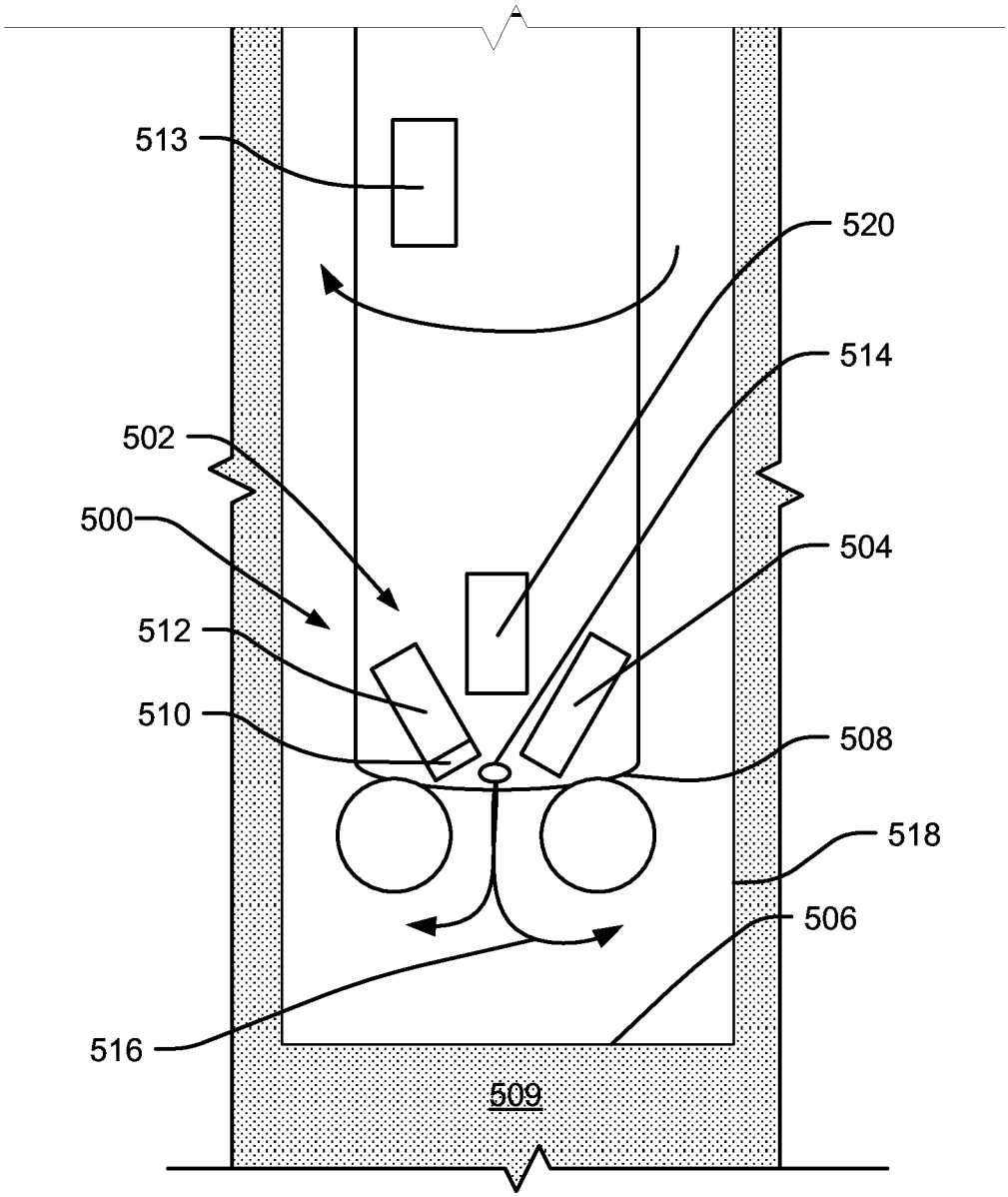
FIG. 5 illustrates various components of a first example device that can implement example embodiments of downhole imaging systems and methods.

FIG. 5 illustrates an example drill bit 500 having an example imaging system 502 disclosed herein, which may be used to implement the example drill bit 105 of the example bottom hole assembly 100 of FIG. 1. In the illustrated example, the imaging system 502 includes a light source 504 to illuminate an area including a target 506 and/or project a pattern of light onto the target 506. In some examples, the light source 504 includes one or more lasers and/or optics to direct, focus, and/or filter the light emitted therefrom. In the illustrated example, an optical field of view of the example imaging system 502 includes an area adjacent an end 508 of the drill bit 500, and the target 506 is a portion of a subterranean formation 509 adjacent the end 508 of the drill bit 500. The example imaging system 502 of FIG. 5 also includes a light sensor 510 and an image processor 512. In some examples, the light sensor 510 includes a camera, a video camera, an image detection plane (e.g., an array of photo detectors disposed substantially on a plane), and/or any other type of light sensor(s). Example imaging systems that can be used to implement the example imaging system 502 of FIG. 5 are described below in conjunction with FIGS. 11 and 12.

During operation of the example drill bit 500, the drill bit 500 and, thus, the example imaging system 502 rotate relative to the target 506, and the example imaging system 502 acquires three-dimensional shape information of the target 506 and/or captures images of the target 506 based on the light projected by the light source 504 and the light received by the light sensor 510. For example, the image processor 512 detects where light is received on the image sensor 510 and, based on where the light is received, the image processor 512 determines a plurality of measurement of the target 506. Based on the measurements, the example image processor 512 determines three-dimensional shape information such as texture data, size data, shape data, and/or other three-dimensional shape information of the target 506. In some examples, the image processor 512 also determines information related to the target 506 such as, for example, color(s) of the target 506, a position of the target 506, a distance of the target 506 relative to one or more components of the drill bit 500, and/or any other target information. In some examples, the image processor 512 analyzes one or more captured images of the target 506 and determines three-dimensional shape information and/or other target information based on the image(s).

In some examples, the example image processor 512 processes and/or formats the target information to facilitate storage of the target information in one or more databases, enable the image processor 512 to associate (e.g., match) the target information or a portion of the target information with predetermined target information stored in one or more databases, facilitate communication of the target information toward a surface of Earth via a low bandwidth telemetry link 513 (e.g., a mud-pulse telemetry link), enable one or more images of the target 506 to be generated, and/or perform and/or facilitate other actions. For example, the image processor 512 may generate vector data based on the image(s) of the target 506, the three-dimensional shape information, and/or other information. In some examples, the image processor 512 generates a spatial gradient vector field such as, for example: grad $$f(x, y) = \left(\frac{\partial f}{\partial x}, \frac{\partial f}{\partial y}\right).$$

In some examples, the vector data is communicated toward the surface in real-time to enable a surface system to generate an image of the target and/or retrieve additional information related to the target.

In the illustrated example, the drill bit 500 includes a port 514 to project flushing fluid 516 into a borehole 518 and the optical field of view of the example imaging system 502. The example flushing fluid 516 is substantially transparent or clear to enable the light generated via the light source 504 to propagate through the flushing fluid 516 to the target 506 and from the target 506 to the image sensor 512. In some examples, the light source 504 generates light at a predetermined wavelength (e.g., infrared wavelengths) to facilitate propagation of the light through the flushing fluid 516.

In the illustrated example, the drill bit 500 includes a flushing fluid system 520 to control the projection of flushing fluid 516 via the drill bit 500. In some examples, the flushing fluid system 520 includes a controller, one or more valves, nozzles, pumps, motors, and/or other components to control an amount of time and/or a schedule during which the flushing fluid 516 is projected into the borehole 518, a rate at which the flushing fluid 516 is expelled from the drill bit 500 via the port 514, a direction in which the flushing fluid 516 is projected, and/or other aspects of operation of the flushing fluid system 520, the drill bit 500, and/or the imaging system 502.

In some examples, the flushing fluid is projected momentarily during times when the example imaging system 502 is directing and receiving light, capturing images of the target 506, and/or determining three-dimensional information of the target 506. In some examples, the flushing fluid is projected substantially continuously, during predetermined intervals of time, and/or using any other pattern or sequence of operation. Example methods and apparatus that can be used to implement the example flushing fluid system 520 of FIG. 5 are described in U.S. application Ser. No. 13/935,492, filed on Jul. 4, 2013, entitled "Downhole Imaging Systems and Methods," which is hereby incorporated by reference herein in its entirety.

Figure 6:
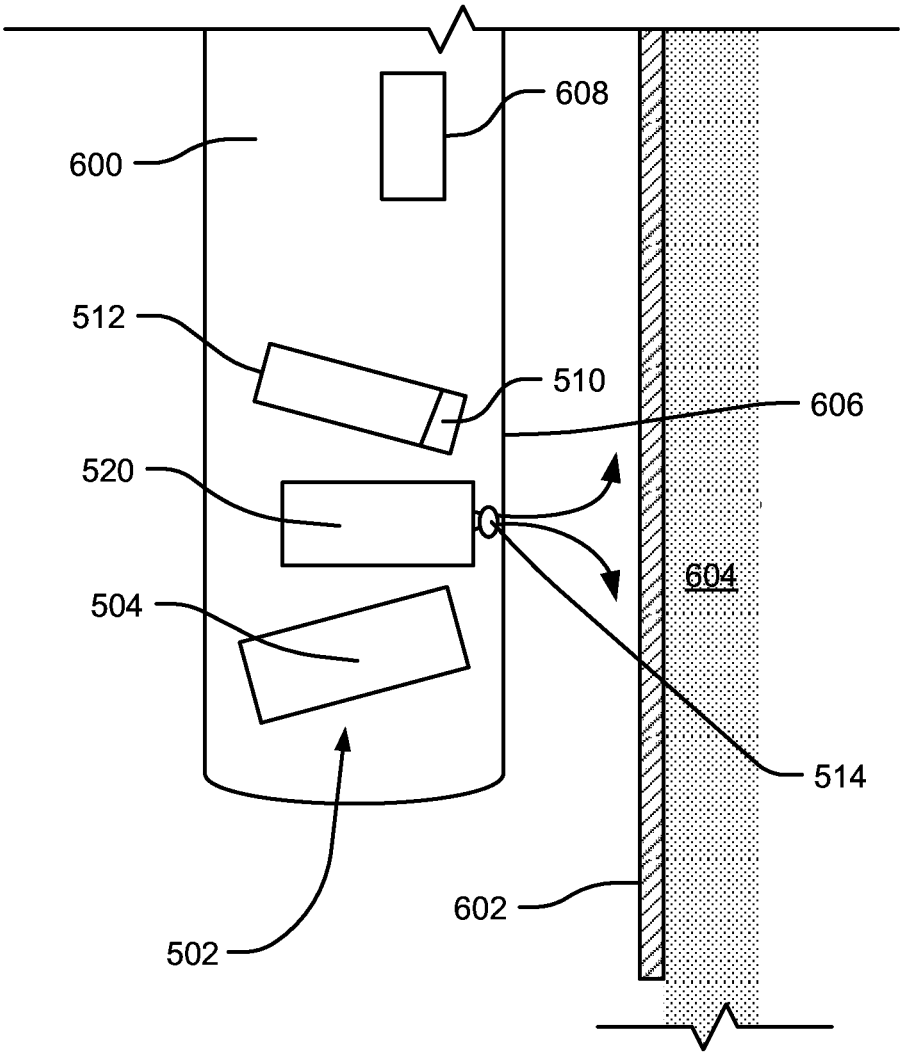
FIG. 6 illustrates various components of a second example device that can implement example embodiments of downhole imaging systems and methods.

FIG. 6 illustrates an example logging tool 600 employing the example imaging system 502 and the example flushing fluid system 520 of FIG. 5 to monitor and/or analyze a casing 602 and/or a subterranean formation 604 adjacent the logging tool 600. The example logging tool 600 of FIG. 6 may be used to implement the example wireline tool 300, the example coiled tubing system 402, and/or any other downhole tool. In the illustrated example, the imaging system 502 is disposed on the example logging tool 600 to enable a field of view of the example imaging system 502 to include an area adjacent a side 606 of the logging tool 600. In some examples, the imaging system 502 determines three-dimensional shape information and/or captures images of the casing 602 and/or the subterranean formation 604. The example logging tool 600 communicates the three-dimensional shape information and/or the images to a surface receiver (e.g., the electronics and processing system 306 of FIG. 3, the receiver hub 438 of FIG. 4, and/or any other surface receiver) substantially in real-time via a transmitter and/or a telemetry link 608.

Figure 7:
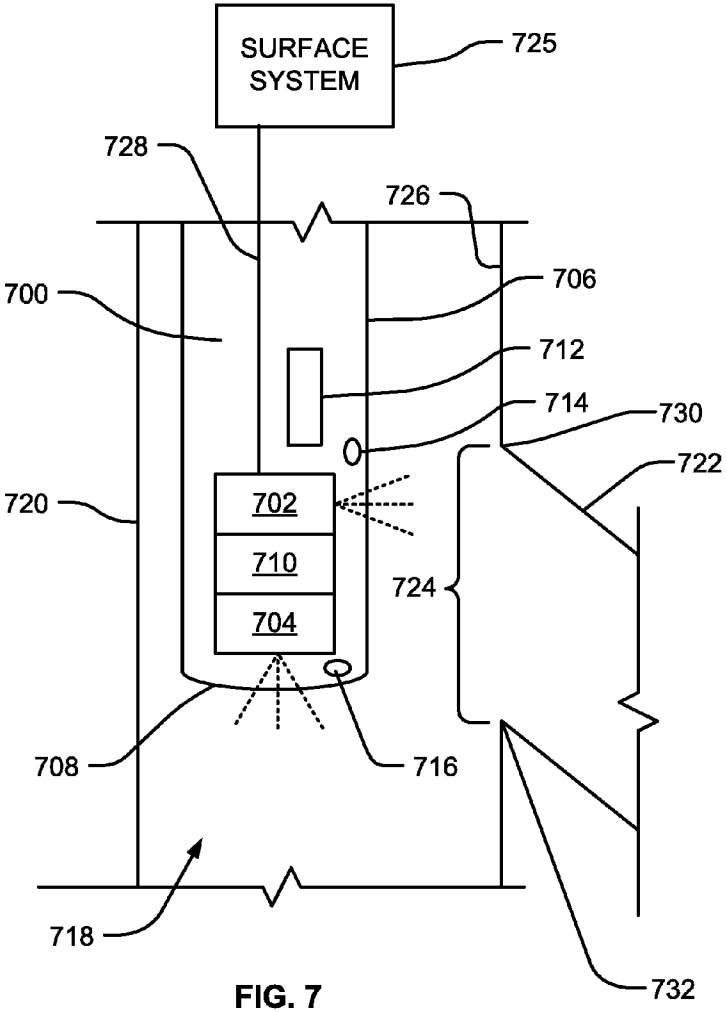
FIG. 7 illustrates various components of a third example device that can implement example embodiments of downhole imaging systems and methods.

FIG. 7 is a schematic of an example downhole tool 700 including an example first imaging system 702 and an example second imaging system 704. In the illustrated example, the first imaging system 702 is disposed on the downhole tool 700 to enable the first imaging system 702 to capture images and/or determine three-dimensional shape information of targets adjacent a side 706 of the downhole tool 700. The example second imaging system 704 of FIG. 7 is disposed on the downhole tool 700 to enable the second imaging system 704 to capture images and/or determine three-dimensional shape information of targets adjacent an end 708 of the downhole tool 700. Other examples include other numbers of imaging systems and/or have imaging systems including different optical fields of view.

In the illustrated example, the downhole tool 700 includes an orientation sensor 710 such as, for example, a gyroscope to determine an orientation (e.g., vertical, horizontal, thirty degrees from vertical, etc.) of the downhole tool. In some examples, the downhole tool 700 includes a depth sensor to determine a depth of the downhole tool 700.

In the illustrated example, a flushing fluid system 712 is disposed on the downhool tool 700 to project flushing fluid through a first port 714 and/or a second port 716 to flush or wash away opaque fluid (e.g., mud, formation fluid, etc.) and/or debris from the fields of view of the first imaging system 702 and/or the second imaging system 704.

In the illustrated example, the downhole tool is disposed in a multilateral well 718 including a first borehole 720 and a second borehole 722 in communication with the first borehole 720. In some examples, the example first imaging system 702 is employed to detect a borehole window 724. In the illustrated example, the borehole window 724 is an opening defined by the first borehole 720 through which the downhole tool 700 may enter the second borehole 722.

In some examples, as the downhole tool 700 is moved (e.g., lowered) in the first borehole 720, the first imaging system 702 generates three-dimensional shape information and/or captures images of a wall 726 of the first borehole 720. In the illustrated example, the three-dimensional shape information, the images and/or other information is communicated to a surface system 725 (e.g., the control unit 436 of FIG. 4) in real-time via a telemetry line 728. In some examples, the surface system 725 displays the images and/or generates images based on the three-dimensional shape information to enable an operator of the downhole tool 700 to inspect the borehole wall 726. As the example downhole tool 700 is moved to and/or past the window 724, the first imaging system 702 captures images and/or determines three-dimensional shape information of the window 724 and/or edges 730, 732 of the first borehole 720 defining the window 724. In some examples, the first imaging system 702 and/or the surface system 725 analyzes the images and/or the three-dimensional shape information to detect the window 724. For example, the first imaging system 702 and/or the surface system 725 may employ edge detection techniques to detect the window 724.

In some examples, the images and/or the three-dimensional shape information is used to determine characteristics of the borehole wall 726 and/or the window 724. For example, the images and/or the three-dimensional shape information may be used to detect corrosion, chemical buildup, physical damage, perforations, surface texture, a size and/or shape of the window 724, a position of the window 724 relative to the downhole tool 700, and/or other characteristics.

Figure 8:
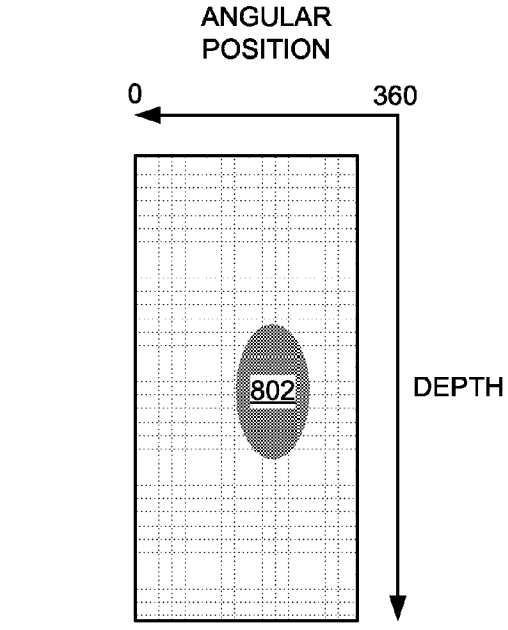
FIG. 8 illustrates an example image generated via the third example device of FIG. 7.

FIG. 8 illustrates an example image 800 of the wall 726 of the first borehole 720 and the window 724 generated via the first image system 702 and/or the surface system 725 based on the images and/or the three-dimensional shape information acquired via the first image system 702 FIG. 7. In the illustrated example, the window 724 is represented in the image 800 by a graphic 802. In some examples, the depth of the window 724 is logged to enable subsequent entry of the downhole tool 700 into the second borehole 722 and/or maintenance of the window 724 such as, for example, treatment of corrosion on and/or near the edges 730, 732 of the window 724.

Figure 9:
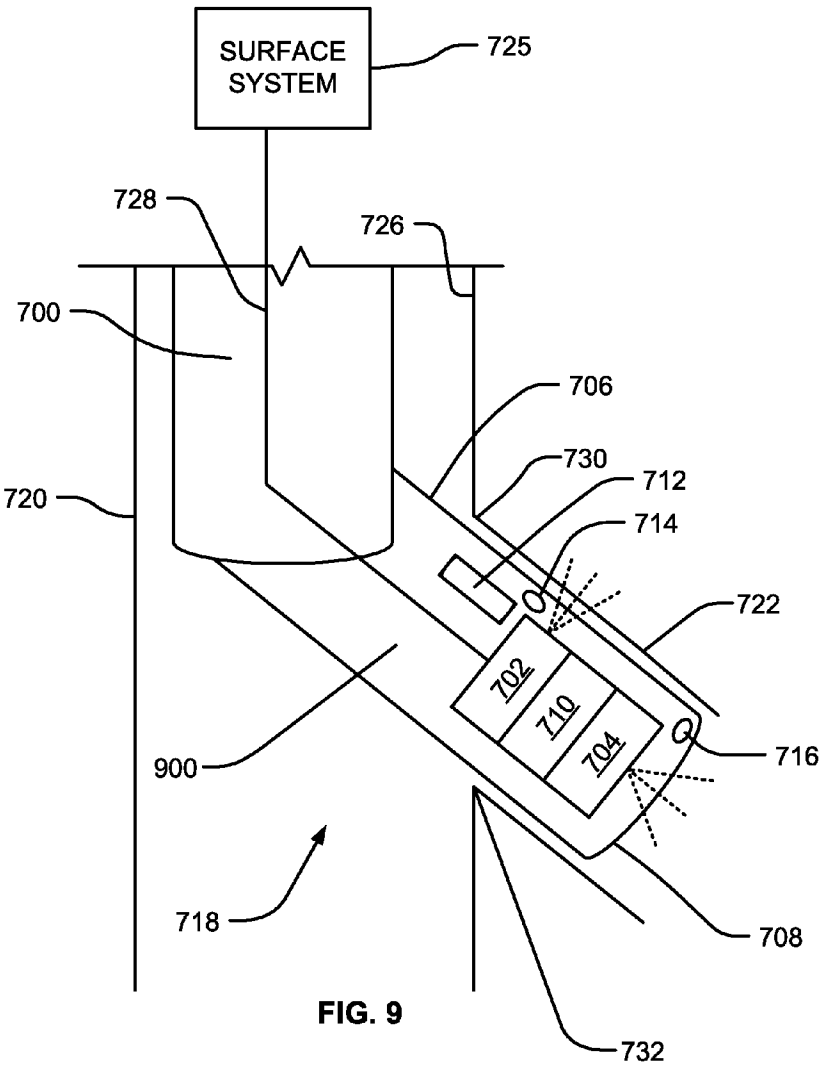
FIG. 9 further illustrates various components of the third example device that can implement example embodiments of downhole imaging systems and methods.

FIG. 9 illustrates the example downhole tool 700 of FIG. 7 entering the second borehole 722 via the window 724. Once the depth and position of the window 724 are determined based on the depth sensor and the image 800, movement of the downhole tool 700 is controlled to enable the downhole tool 700 to move from the first borehole 720 into the second borehole 722. In the illustrated example, the downhole tool includes a bent sub 900 that enables the downhole tool 700 to bend or angle the bent sub 900 toward the window 724.

Figure 10:
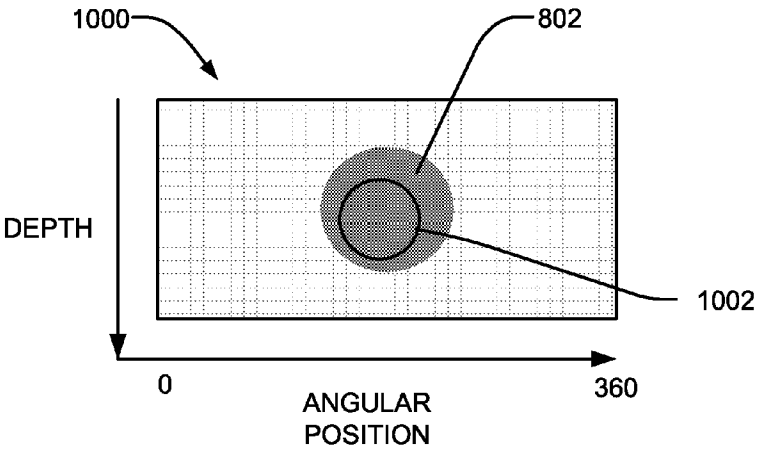
FIG. 10 illustrates another example image generated via the third example device of FIGS. 7 and 9.

FIG. 10 illustrates an example image 1000 generated via the example second image system 704 as the example bent sub 900 is oriented to enter the second borehole 722. In the illustrated example, the image 1000 includes an alignment reference 1002 to facilitate entry of the downhole tool 700 into the second borehole 722. In the illustrated example, the alignment reference 1002 is a circle indicating a center of the field of view of the example second imaging system 704. In other examples, the alignment reference 1002 may be other indicators such as, for example, crosshairs. In the illustrated example, to align the example bent sub 900 to enable the downhole tool 700 to enter the second borehole 722, an operator of the downhole tool 700 monitors the image 1000 and moves the downhole tool 700 (e.g., orients the bent sub 900) such that the alignment reference 1002 is substantially on a center of the graphic 802 representing the window 724. In the illustrated example, as the downhole tool 700 is controlled, three dimensional shape information and/or images acquired via the example second imaging system 704 are communicated to the surface system 725 in real-time to enable the operator to accurately and effectively maneuver the example downhole tool into the second borehole 722.

In some examples, entry of the downhole tool 700 into the second borehole 722 is detected and/or verified based on an orientation of the bent sub 900 determined via the orientation sensor 710. For example, if the orientation sensor 710 determines that the bent sub 900 is oriented at a predetermined angle away from being vertical, the entry of the downhole tool 700 into the second borehole 722 is detected and/or verified. In some examples, entry of the downhole tool 700 into the second borehole 722 is fully automated and/or semi-automated via the surface system 725 and/or downhole controllers employing the images 800, 100 and/or three-dimensional shape information generated via the first imaging system 702 and/or the second imaging system 704.

Figure 11:
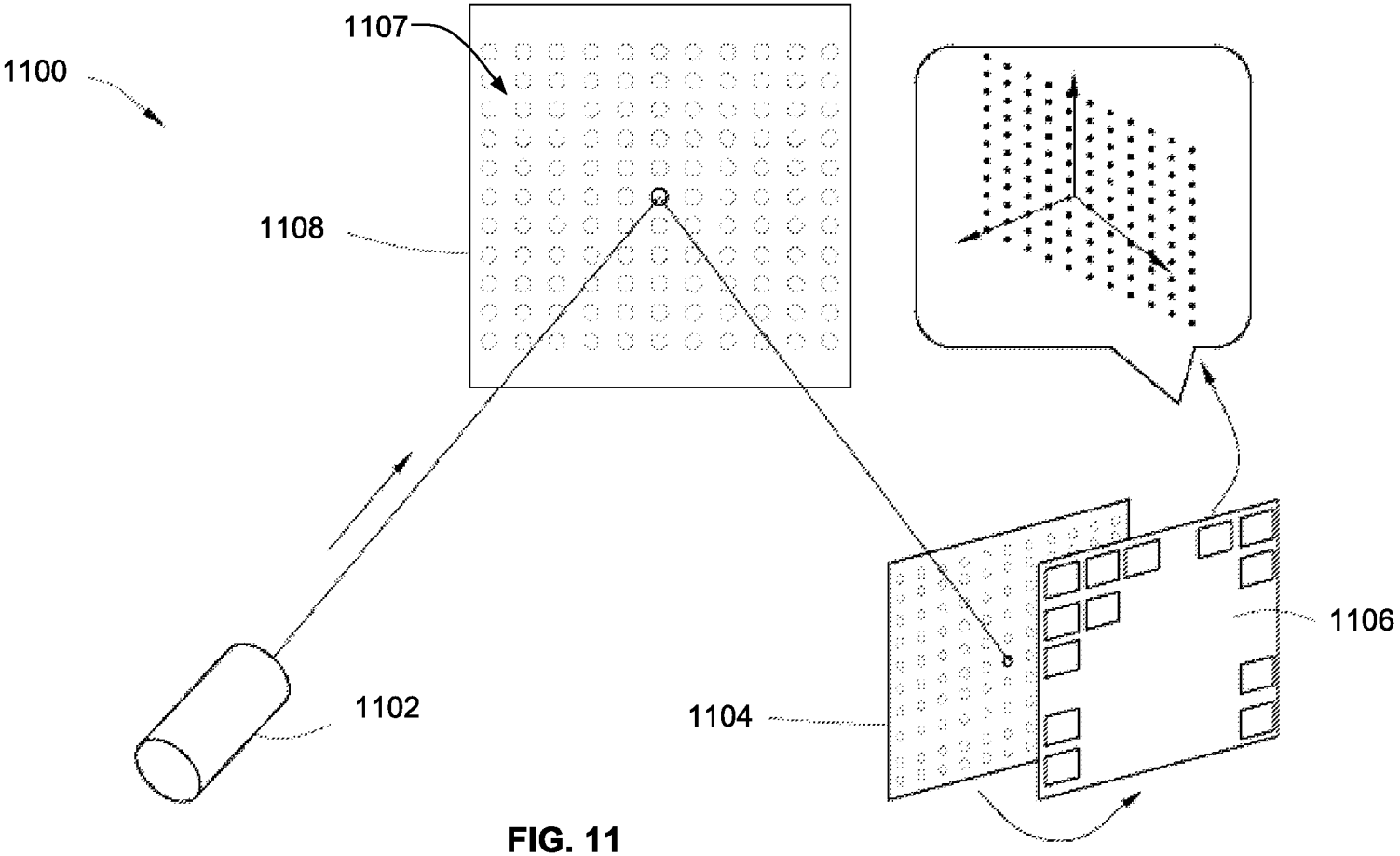
FIG. 11 illustrates various components of a fourth example device that can implement example embodiments of downhole imaging systems and methods.

FIG. 11 illustrates an example imaging system 1100 disclosed herein, which can be used to implement the example imaging system 502 of FIGS. 5-6, the example first imaging system 702 of FIGS. 7 and 9, and/or the example second imaging system 704 of FIGS. 7-9. In the illustrated example, the imaging system 1100 includes a light source 1102, an image detection plane 1104, and an image processor 1106. In the illustrated example, the light source 1102 includes one or more lasers to project a first pattern of light 1107 onto a target 1108 such as, for example, a casing, a subterranean formation, and/or any other target. Light directed from the target 1108 is received by the image detection plane 1104 and analyzed by the image processor 1106 to determine three-dimensional shape information of the target 1108 and/or generate an image of the target 1108. In the illustrated example, the first pattern of light 1107 includes a plurality of spots disposed in a rectangular array. Other examples employ other patterns.

The example image detection plane 1104 includes a plurality of detectors disposed in a substantially planar array. In some examples, the image processor 1106 includes an array of photo detectors and/or pixel sensors in communication with processing elements. In some examples, each of the processing elements determines three-dimensional shape information of a portion of the target 1106 that corresponds to a portion (e.g., pixel) of the image of the target 1106. In some examples, the example imaging system 1100 of FIG. 11 is implemented via an image processor described in U.S. patent application Ser. No. 13/860,540, filed on Apr. 11, 2013, entitled "High-Speed Image Monitoring of Baseplate Movement in a Vibrator," which is hereby incorporated by reference herein in its entirety.

In some examples, the imaging system 1100 of FIG. 11 determines three-dimensional shape information of the target 1108 using a technique described in "Watanabe, et al., 955-fps Real-time Shape Measurement of a Moving/Deforming Object using High-speed Vision for Numerous-point Analysis", 2007 IEEE International Conference on Robotics and Automation, Roma, Italy, 10-14 Apr. 2007, which is hereby incorporated by reference herein in its entirety. For example, the light source 1102 may project a plurality of pre-calibrated spots onto the target 1108. Projecting the plurality of spots enables high accuracy in each spot to reduce and/or remove intensity noise and simplifies image processing to increase processing speed, which may result in high-frame-rate imaging and low-latency visual feedback, respectively. In some examples, the three-dimensional shape information is obtained via a single frame. In some examples, other patterns are used such as, for example, multiple slits or a grid of light. In some examples, the light source 1102 includes one or more light emitting diodes (LEDs) to project one or more color patterns onto the target 1108.

In the illustrated example, each measured spot lies on the intersection of two lines: a projection line and a vision constraining line. If geometric information about the projected line is known, a three-dimensional point $Mi=[X_w, Y_w, Z_w]^t$ can be determined from an image point $m_i=[X_v, Y_v]^t$. Suffix i indicates the spot number. The expression for the projection line is shown in Equation 1:

$$M_i=c+\delta s_i(i=1, \ldots, Np). \quad \text{Equation 1:}$$

The projection line of Equation 1 is a line with gradient s, passing through a projection center c and on which the measured spot i lies. $N_p$ is a total number of projected spots. An expression for the vision constraining line is shown in Equation 2 below:

$$P\tilde{M}_i=w\tilde{m}_i. \quad \text{Equation 2:}$$

The expression of the vision constraining line illustrates a relationship between image point $\tilde{m}_i=[m_i^t, 1]^t$ of spot i and a three-dimensional point $\tilde{M}_i$ connected by perspective projection matrix P.

In Equations 1 and 2, c, $s_i$, and P are known parameters, and $m_i$ is observed data. The three-dimensional point $M_i$ is obtained from Equations 1 and 2 form the observed image points. The example imaging system 1100 enables high-speed image processing employing a large number of calculations by using a parallel and dedicated vision processing unit as a co-processor. An example vision processing unit is described in Watanabe, et al., 955-fps Real-time Shape Measurement of a Moving/Deforming Object using High-speed Vision for Numerous-point Analysis", 2007 IEEE International Conference on Robotics and Automation, Roma, Italy, 10-14 Apr. 2007.

In some examples, the image processor 1106 calculates image moments as spot information. The image moments are parameters that can be converted or formatted to various geometric features such as, for example, size, centroid, orientation, shape information, and/or other geometric features. The (i+j)th image moments $m_{ij}$ are calculated from Equation 3 below:

$$mij = \sum_x \sum_y xiyjI(x, y). \quad \text{Equation 3}$$

In Equation 3, I(x, y) is the value at pixel (x, y). In the illustrated example, by employing a parallel processing unit, the example image processor 1104 uses $O(\sqrt{n})$ calculations and enables observation or monitoring of a few thousand objects at frame rates of thousands of frames per second.

A geometrical relationship between the image detection plane 1104 and each spot projected via the light source 1102 is predetermined via calibration. Calibration can be set by determining the following three functions of Equation 4 from known pairs of three-dimensional points $M_i$ and image points $m_i$ of each projected spot i without obtaining intrinsic parameters c, $s_i$, and P:

$$[x_w, y_w, z_w]^t=[f_1^i(z_w), f_2^i(z_w), f_3^i(X_v)]^t. \quad \text{Equation 4:}$$

Functions $f_1^i$ and $f_2^i$ are used to determine the $x_w$ and $y_w$ coordinates of the three-dimensional point for spot i from a depth distance $z_w$. The relationships are expressed as a linear function in Equation 5 below:

$$f_i^i(z_w)=\alpha_{j,1}^{(i)}z_w+\alpha_{j,0}^{(i)} \ (j=1, 2). \quad \text{Equation 5:}$$

The function $f_3^i$ is used to determine the depth distance $z_w$ from the $X_v$ coordinate of an image point. In some examples, the function $f_3^i$ is expressed as a hyperbola about $X_v$ and $Y_v$. In other examples (e.g., over a small range), the function $f_3^i$ can be determined via a polynomial expression shown in Equation 6 below:

$$f_3^i(X_v)=\Sigma_{k=1}^n\alpha_{3,k}^{(i)}X_v^k. \quad \text{Equation 6:}$$

In some examples, a two-dimensional polynomial approximation is employed. In some examples, the function $f_3^i$ is determined by obtaining multiple spot patterns to $x_w y_w$ planes at known distances $z_w$.

In some examples, the image processor 1106 determines which image point corresponds to each projected spot based on a previous frame via a tracking-based technique, which can perform dynamic modification of a search area according to pattern changes. In some examples, at a beginning or an outset of the measurement, initialization is performed.

A start time t(i) of projecting about each spot i is expressed as follows:

$$t(i)=T_\delta(i\in A_\delta: \delta=1, \ldots, N_e). \quad \text{Equation 7:}$$

In Equation 7, $A_\delta$ is a class of projected spots having epipolar lines $l_t(Y_v=l_t(X_v))$ constraining movement of spot i in the image space that do not intercross. Ne is the number of divided classes. Initialization enables high versatility. Moreover, because this spot pattern is already projected when commencing sequential frame operation, substantially no loss of three-dimensional shape information occurs after the measurement begins.

After initialization, three-dimensional shape information is measured in input frames. When the frame rate is high relative to changes in the target shape, differences between spots projected on a smooth surface between successive frames is small. Thus, an operation to correspond an image point to a spot i could be expressed as a tracking operation between frames, in which a point $m_i(t-1)$ corresponding to a point m(t) is searched for using corrected points at time t−1 based on the following evaluation:

$$\min\{|m_i(t-1)-m(t)|+|M_i(t-1)\tilde{M}(t)|. \quad \text{Equation 8:}$$

Searching of neighbor points in two-dimensional image space can be performed using a bucket method, which can efficiently perform the search operation of the nearest point to an input point by dividing the search space into grids and accessing neighbor areas. The bucket method enables the number of calculations to have a linear relationship relative to the number of measured image points if the points are distributed substantially equally, which results in an equal number of points included within each grid.

In some examples, points move discontinuously because they are on points of contact between the measured object and the projected line of the spot. These points are mapped exceptionally by using the epipolar line based on the following evaluation:

$$\min\{|Y_v(t)-l_t(X_v(t))|\}. \quad \text{Equation 9:}$$

A number of these discontinuously moving points can be assumed to be small. In some examples, constraints are defined for the speed at which these points jump or change in the depth direction between frames in order to avoid overlapping spots in the image space.

Figure 12:
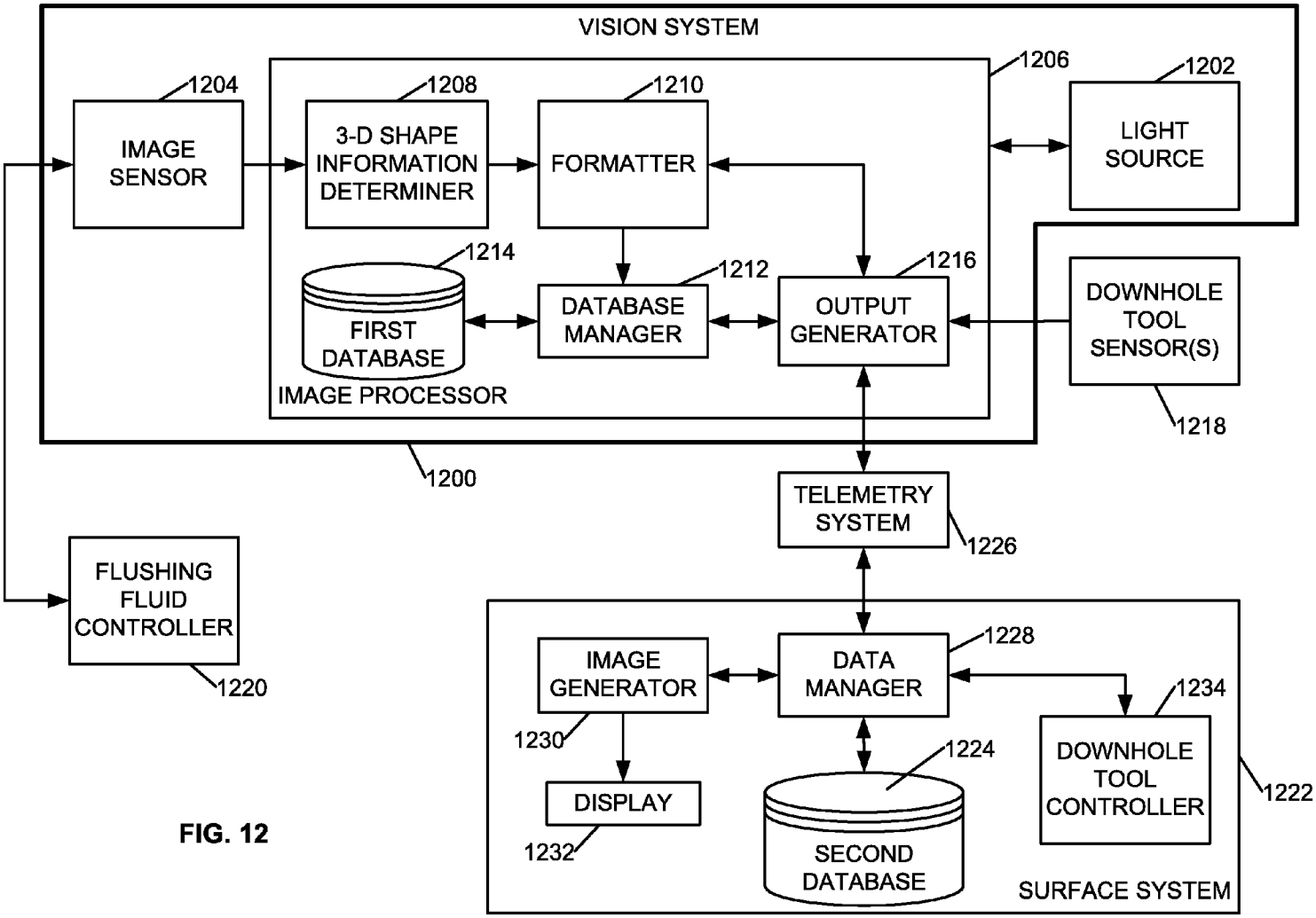
FIG. 12 illustrates various components of a fifth example device that can implement example embodiments of downhole imaging systems and methods.

FIG. 12 is a block diagram representative of an example imaging system 1200 disclosed herein, which can be used to implement the example imaging system 502 of FIGS. 5-6, the example first imaging system 702 of FIGS. 7 and 9, the example second imaging system 704 of FIGS. 7-9 and/or the example imaging system 1100 of FIG. 11. In the illustrated example, the imaging system 1200 includes a light source 1202, an image sensor 1204, and an image processor 1206. The example image processor 1206 of FIG. 12 includes a three-dimensional information determiner 1208, a formatter 1210, a database manager 1212, a first database 1214 and an output generator 1216. In the illustrated example, one or more downhole tool sensors 1218 such as, for example, a depth sensor, a gyroscope, and/or any other sensors are in communication with the image processor 1206.

In some examples, the light source 1202 includes one or more lasers, light emitting diodes, and/or any other light source. Light generated via the light source 1202 may be directed toward a target via an optical fiber, an optical fiber bundle and/or optics (e.g., lenses, filters, etc.). In some examples, the light source 1202 generates light having a wavelength that enables the light to propagate through flushing fluid projected into a field of view of the example imaging system 1200. In some examples, the light source 1202 directs a pattern of light such as, for example, an array of spots onto and/or toward the target.

In the illustrated example, the image sensor 1204 can be implemented via a camera, a video camera, an image detection plane such as the example image sensor 1104 of FIG. 11 and/or any other image sensor. The example image sensor 1204 of FIG. 12 captures images of a target and/or detects light directed from the target. In some examples, the image sensor 1204 captures images and/or detects light when the flushing fluid is projected into the field of view of the example imaging system 1200. In some examples, a flushing fluid controller 1220 is in communication with the example imaging system 1200 to control and/or coordinate the projection of flushing fluid with operation of the light source 1202 and/or the image sensor 1204.

The example three-dimensional shape information determiner 1208 of the example imaging system 1200 determines three-dimensional shape information of the target based on the images captured and/or the light received via the image sensor 1204. For example, the three-dimensional shape information determiner 1208 may determine three-dimensional shape information based on the technique described above in conjunction with FIG. 11, the technique described in Watanabe, et al., 955-fps Real-time Shape Measurement of a Moving/Deforming Object using High-speed Vision for Numerous-point Analysis," 2007 IEEE International Conference on Robotics and Automation, Roma, Italy, 10-14 Apr. 2007, and edge detection technique and/or any other technique(s). In some examples, the three-dimensional shape information determiner 1208 determines a three-dimensional pattern of the target such as, for example, a texture.

The example formatter 1210 formats and/or processes the three-dimensional shape information to facilitate storage of the three-dimensional shape information, real-time communication of the three-dimensional shape information, and/or generation of image(s). In some examples, the formatter 1210 generates vector data based on the image(s) and/or the three-dimensional shape information. In some examples, the vector data is a spatial gradient vector field (e.g., grad $$\left(\text{e.g., grad } f(x, y) = \left(\frac{\partial f}{\partial x}, \frac{\partial f}{\partial y}\right)\right).$$

In some examples, the vector data includes a shape, a size, a plurality of measurements, and/or other three-dimensional shape information.

In the illustrated example, the first database 1214 includes predetermined target information such as, for example, target names or types, target three-dimensional patterns (e.g., textures), shapes, sizes, and/or other predetermined target information. In some examples, the predetermined target data is organized and/or indexed via one or more database indexes (e.g., numbers, letters, and/or any database index and/or organizational scheme). In some examples, the first database 1214 is used to store downhole tool depth information, downhole tool orientation information, and/or any other information generated via the downhole tool sensor(s) 1218.

The example database manager 1212 of FIG. 12 retrieves predetermined three-dimensional shape information from the first database 1214 and/or stores three-dimensional shape information and/or images in the first database 1214. In some examples, the database manager 1212 associates the three-dimensional shape information determined via the three-dimensional shape information determiner 1208 with predetermined target information stored in the first database 1214. For example, in some examples, the database manager 1212 matches vector data generated via the formatter 1210 with predetermined target information stored in the first database 1210. For example, the vector data may include sensed and/or measured texture data, and the database manager 1212 matches the texture data to predetermined texture data stored in the first database 1214 via spatial correlation. In some examples, the database manager 1212 determines a database index assigned to and/or associated with the predetermined target information matched with vector data. As described in greater detail below, in some examples, the database index is communicated to a surface system 1222 having a second database 1224 organized and/or indexed via the same or similar database indexes of the first database 1214 to enable additional information related to the target to be retrieved.

The example output generator 1216 generates an output and communicates the output to the surface system 1222 via a telemetry system 1226 employing, for example, a transmitter, a telemetry link (e.g., a mud-pulse telemetry link, etc.) and/or any other telemetry tools. In some examples, the output generator 1216 generates an output including one or more images, three-dimensional shape information, vector data, one or more database indexes, and/or outputs including other information. In some examples, the telemetry system 1226 has limited or low bandwidth, and the output generator 1216 generates an output communicable in real-time to the surface system 1222. For example, the output generator 1216 may communicate the database index and/or vector data without images of the target.

The example surface system 1222 of FIG. 12 includes a data manager 1228, an image generator 1230, a display 1232, a downhole tool controller 1234, and the second database 1224. In the illustrated example, the data manager 1228 processes, analyzes, formats and/or organizes information received from the example imaging system 1200. In some examples, the data manager 1228 retrieves information from the second database 1224 based on the output generated by the output generator 1216 and communicated to the surface system 1222. In some examples, the data manager 1228 communicates information to the example imaging system 1200.

In some examples, if the data manager 1228 receives a database index from the example imaging system 1200, the data manager 1228 may retrieve predetermined target information stored in the second database 1224 that is assigned to and/or associated with the database index. In some examples, the second database 1224 includes more predetermined target information than the first database 1214. For example, the first database 1214 may include predetermined texture data, and the second database 1224 may include information associated with the predetermined texture data such as, for example, a composition of a portion of a subterranean formation, an indication of a condition of a casing (e.g., presence of corrosion, cracks, perforations, etc.), an indication of a borehole window, an indication of material build-up around the borehole window, and/or other target information. Thus, the three-dimensional shape information 1208 determined via the example imaging system 1200 may be used to determine and/or retrieve information related to the target.

The predetermined target information may be presented to an operator of a downhole tool via the display 1232 and/or used by the downhole tool controller 1234 to control operation of the downhole tool. In some examples, the image generator 1230 generates images of the target based on the output communicated to the example surface system 1222. For example, if the output is vector data, the example image generator 1230 may generate one or more images based on the vector data, and the images may be displayed via the example display 1232 of FIG. 12. In some examples, the data manager 1228 analyzes the images generated via the image generator 1230 and/or stores the images and/or information determined via the images in the second database 1224. In some examples, the data manager 1228 communicates information to the example imaging system 1200 to be used to control the imaging system 1200 and/or stored in the first database 1214.

In some examples, the example downhole tool controller 1234 controls operation of the imaging system 1200 and/or the downhole tool on which the example imaging system 1200 is disposed based on the output generated via the output generator 1216. For example, if the data manager 1228 receives three-dimensional shape information and/or images from the imaging system 1200 and determines that the downhole tool is adjacent a borehole window, the example downhole tool controller 1234 may operate the downhole tool to move the downhole tool through the borehole window and into a lateral borehole as described in conjunction with FIGS. 7-10 above. In some examples, the downhole tool controller 1234 operates a treatment system of the downhole tool. For example, if the output communicated to the example surface system 1222 by the example imaging system 1200 indicates corrosion and/or material buildup is present around and/or near a borehole window, the downhole tool controller 1234 projects treatment fluid toward the borehole window to remove the corrosion and/or the material buildup.

While an example manner of implementing the example imaging system 502 of FIGS. 5-6, the example first imaging system 702 of FIG. 7, the example second imaging system 704 of FIG. 7, and/or the example imaging system 1100 of FIG. 11 is illustrated in FIG. 12, one or more of the elements, processes and/or devices illustrated in FIG. 12 may be combined, divided, re-arranged, omitted, removed and/or implemented in any other way. Further, the example image light source 1202, the example image sensor 1204, the example image processor 1206, the example three-dimensional shape information determiner 1208, the example formatter 1210, the example database manager 1212, the example first database 1214, the example output generator 1216, the example downhole tool sensor(s) 1218, the example flushing fluid controller 1220, the example telemetry system 1226, the example surface system 1222, the example second database 1224, the example data manager 1226, the example image generator 1230, the example display 1232, the example downhole tool controller 1232 and/or, more generally, the example imaging system 1200 of FIG. 12 may be implemented by hardware, software, firmware and/or any combination of hardware, software and/or firmware. Thus, for example, any of the example image light source 1202, the example image sensor 1204, the example image processor 1206, the example three-dimensional shape information determiner 1208, the example formatter 1210, the example database manager 1212, the example first database 1214, the example output generator 1216, the example downhole tool sensor(s) 1218, the example flushing fluid controller 1220, the example telemetry system 1226, the example surface system 1222, the example second database 1224, the example data manager 1226, the example image generator 1230, the example display 1232, the example downhole tool controller 1232 and/or, more generally, the example imaging system 1200 of FIG. 12 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example image light source 1202, the example image sensor 1204, the example image processor 1206, the example three-dimensional shape information determiner 1208, the example formatter 1210, the example database manager 1212, the example first database 1214, the example output generator 1216, the example downhole tool sensor(s) 1218, the example flushing fluid controller 1220, the example telemetry system 1226, the example surface system 1222, the example second database 1224, the example data manager 1226, the example image generator 1230, the example display 1232, the example downhole tool controller 1232 and/or, more generally, the example imaging system 1200 of FIG. 12 is/are hereby expressly defined to include a tangible computer readable storage device or storage disk such as a memory, a digital versatile disk (DVD), a compact disk (CD), a Blu-ray disk, etc. storing the software and/or firmware. Further still, the example imaging system 1200 of FIG. 12 may include one or more elements, processes and/or devices in addition to, or instead of, those illustrated in FIG. 12, and/or may include more than one of any of the illustrated elements, processes and devices.

Figure 13:
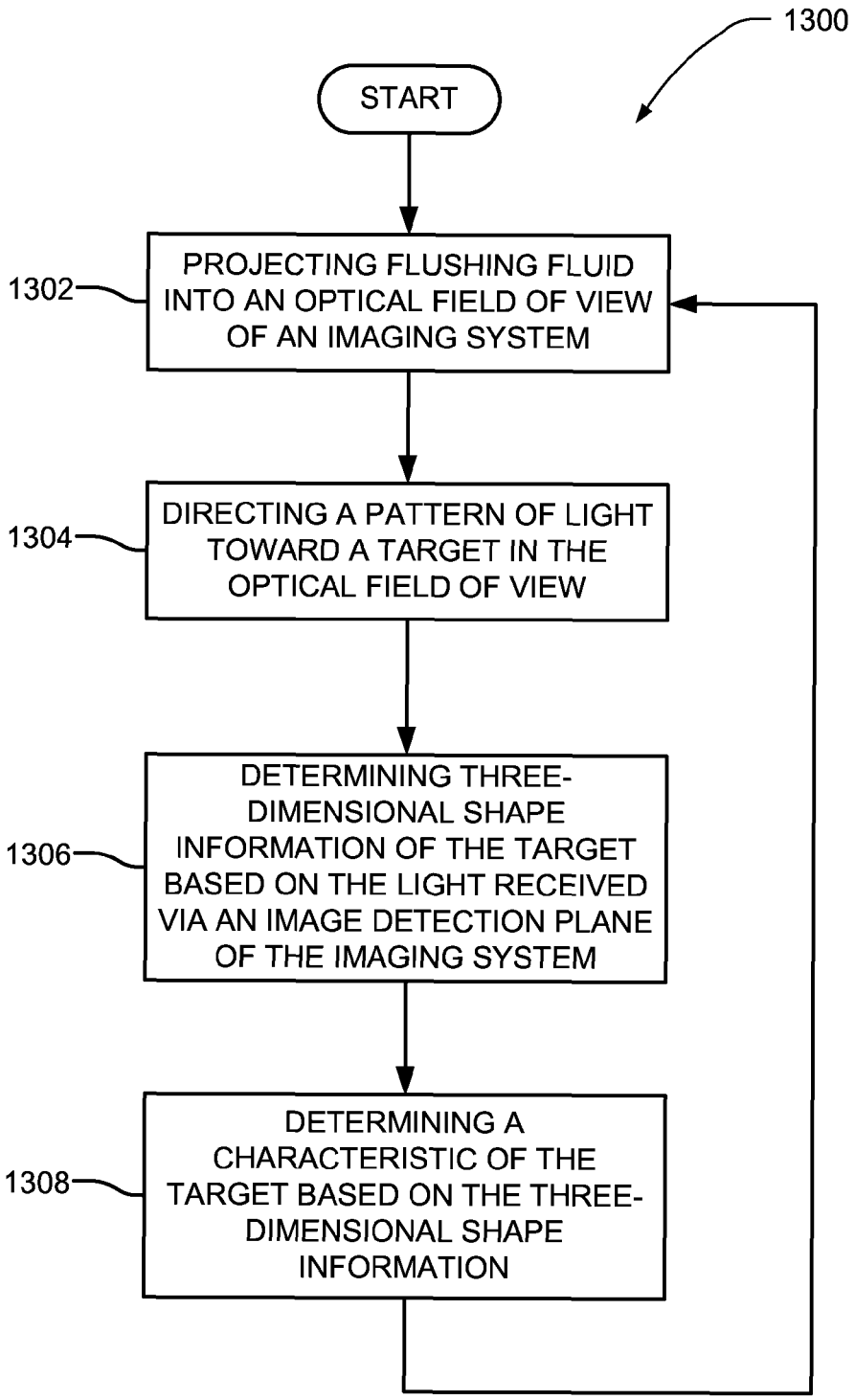
FIG. 13 illustrates example method(s) in accordance with one or more embodiments.
Figure 14:
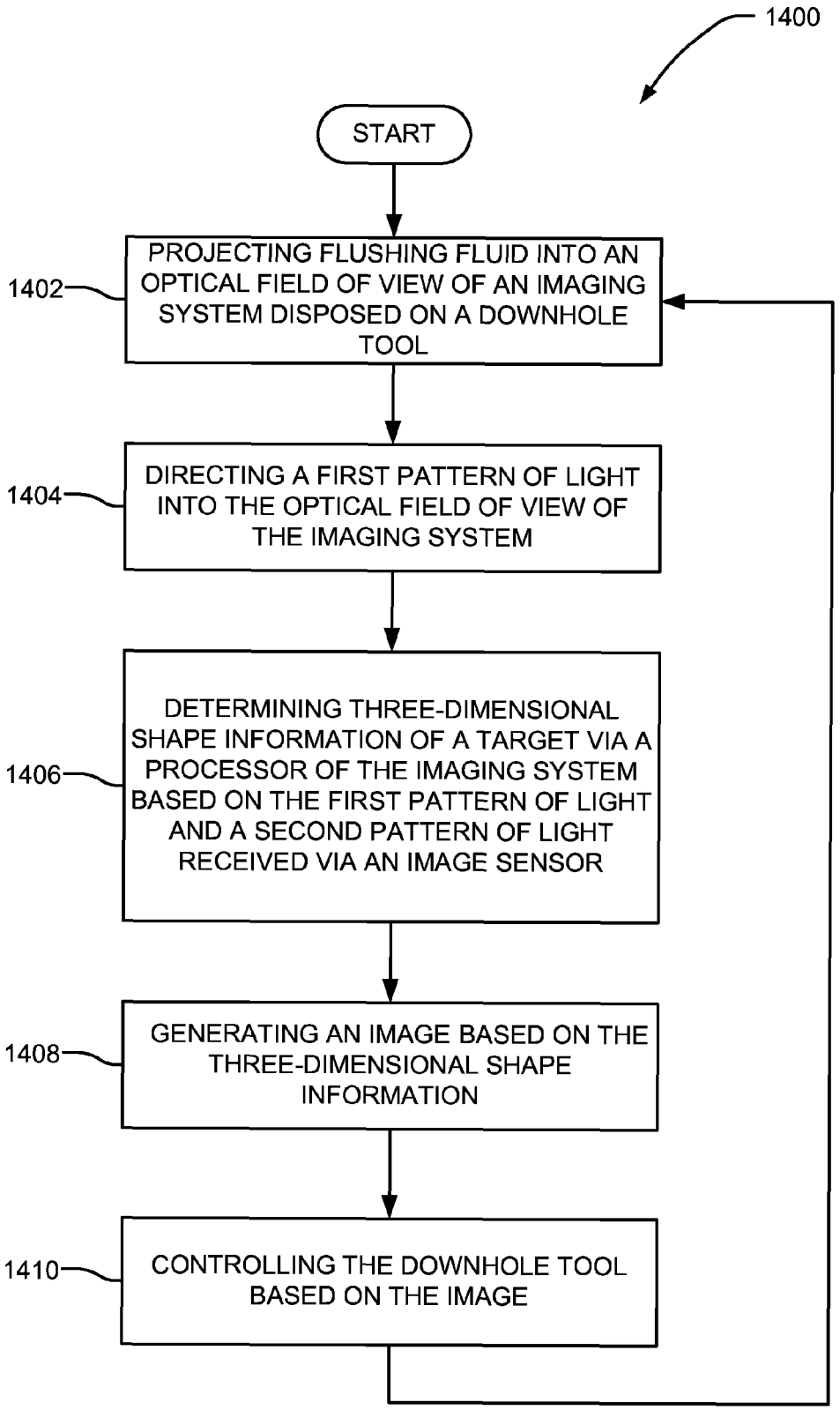
FIG. 14 illustrates example method(s) in accordance with one or more embodiments.
Figure 15:
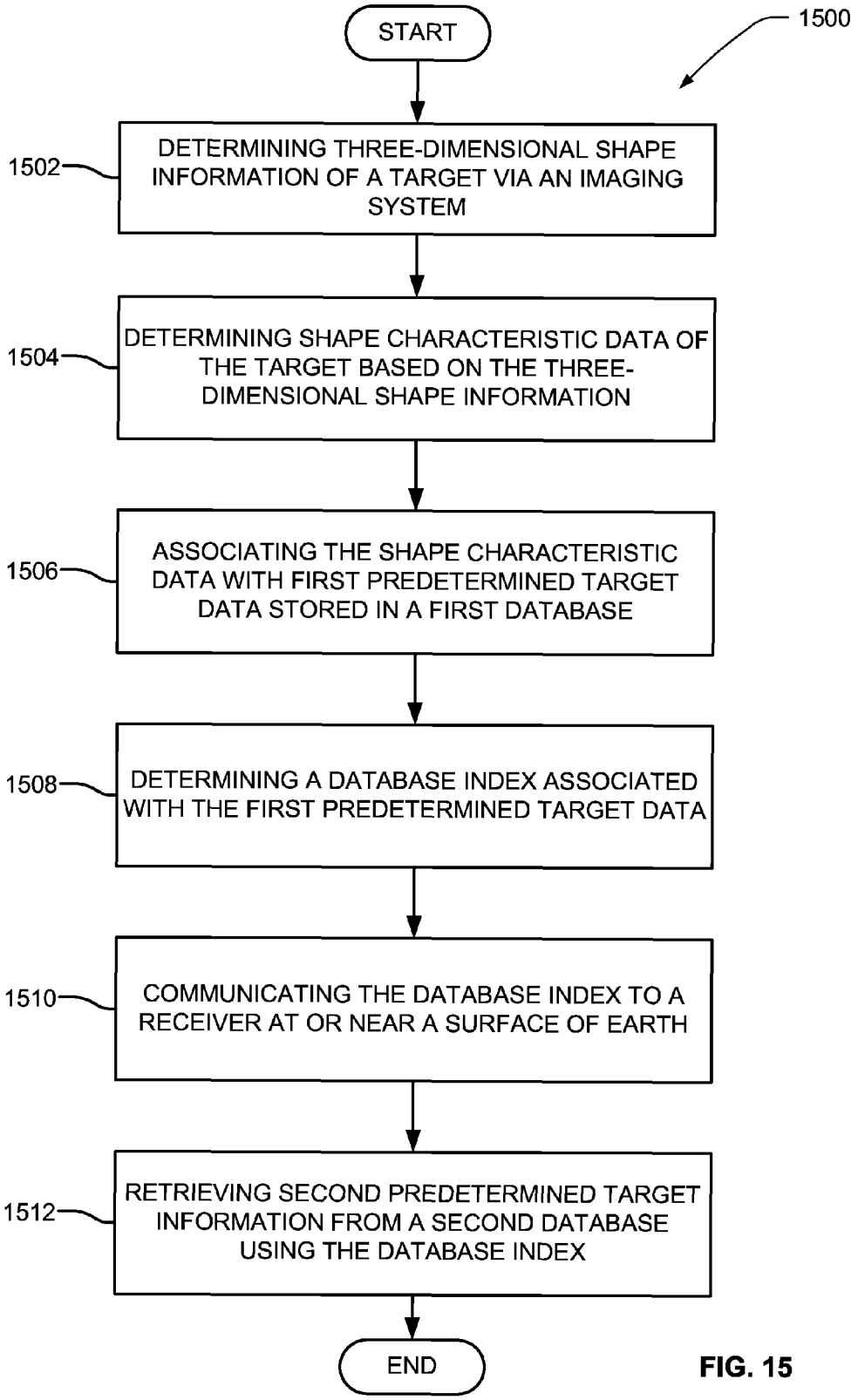
FIG. 15 illustrates example method(s) in accordance with one or more embodiments.

Flowcharts representative of example methods for implementing the example imaging system 502 of FIGS. 5-6, the example first imaging system 702 of FIG. 7, the example second imaging system 704 of FIG. 7, the example imaging system 1100 of FIG. 11, and/or the example imaging system 1200 of FIG. 12 are shown in FIGS. 13-15. In these examples, the methods may be implemented using machine readable instructions comprising a program for execution by a processor such as the processor 1612 shown in the example processor platform 1600 discussed below in connection with FIG. 16. The program may be embodied in software stored on a tangible computer readable storage medium such as a CD-ROM, a floppy disk, a hard drive, a digital versatile disk (DVD), a Blu-ray disk, or a memory associated with the processor 1612, but the entire program and/or parts thereof could be executed by a device other than the processor 1612 and/or embodied in firmware or dedicated hardware. Further, although the example methods are described with reference to the flowcharts illustrated in FIGS. 13-15, many other methods of implementing the example imaging system 502 of FIGS. 5-6, the example first imaging system 702 of FIG. 7, the example second imaging system 704 of FIG. 7, the example imaging system 1100 of FIG. 11, and/or the example imaging system 1200 of FIG. 12 may be used. For example, the order of execution of the blocks may be changed, and/or some of the blocks described may be changed, removed, or combined.

As mentioned above, the example methods of FIGS. 13-15 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. The example methods of FIGS. 13-15 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

The example method 1300 of FIG. 13 beings by projecting flushing fluid into an optical field of view of an imaging system (block 1302). For example, the example flushing fluid system 520 may project flushing fluid 516 into the borehole 518 and the optical field of view of the example imaging system 502. A pattern of light is directed toward a target in the optical field of view (block 1304). The target may include an area, space, surface and/or object in the optical field of view. For example, the light source 504 may direct an array of spots onto a portion of the casing 602. In some examples, the light is directed toward the target during a time when the flushing fluid is being projected into the optical field of view of the imaging system to flush away and remove opaque fluid and/or debris from the field of view.

Three-dimensional shape information of the target is determined based on the light received via an image detection plane of the imaging system (block 1306). In some examples, the three-dimensional shape information includes a plurality of measurements based on where the light is received by the image detection plane relative to the pattern of light directed toward the target. In some examples, the example image processor 1106 determines the three-dimensional information using the technique described in Watanabe, et al., "955-fps Real-time Shape Measurement of a Moving/Deforming Object using High-speed Vision for Numerous-point Analysis," 2007 IEEE International Conference on Robotics and Automation, Roma, Italy, 10-14 Apr. 2007.

A characteristic of the target is determined based on the three-dimensional shape information (block 1308). The characteristic may include a size; a shape; a texture; recognition and/or identification of an object such as, for example, a composition of a subterranean formation, a borehole window, material buildup, a crack, a perforation, etc.; recognition and/or identification of a condition of an object such as, for example corrosion, wear, etc.; movement of an object; and/or any other characteristic. In some examples, the characteristic of the target is determined by analyzing the three-dimensional shape information and/or one or more images generated based on the three-dimensional shape information. The example method 1300 then returns to block 1302 and, thus, the example method 1300 may be used to monitor targets in the optical field of view of an imaging system while a downhole tool is operating such as, for example, during drilling, navigation of the downhole tool through a multilateral well, sampling, etc.

FIG. 14 is a flowchart representative of another example method 1400 disclosed herein. The example method 1400 of FIG. 14 begins by projecting flushing fluid into an optical field of view of an imaging system disposed on a downhole tool (block 1402). For example, the example flushing fluid system 712 may project flushing fluid into the optical field of view of the example first imaging system 702 and/or the example second imaging system 704 disposed on the example downhole tool 700.

A first pattern of light is directed into an optical field of view of the imaging system (block 1404). For example, a light source (e.g., the example light source 1102) of the example first imaging system 702 may direct an array of spots toward the wall 726 of the first borehole 720. Three-dimensional shape information of a target is determined via a processor of the imaging system based on the first pattern of light and a second pattern of light received via an image sensor (block 1406). For example, some of the spots of light directed onto the wall 726 may be directed to the image detection plane 1104. In some examples, the spots of light may be directed from the wall 726 to the image detection plane 1104 at angles different than angles at which the spots of light were directed onto the wall 726 via the light source 1102 because of a shape (e.g., curvature, texture, presence of cracks or apertures, etc.) of the wall 726. In some examples, the image processor 1106 determines a plurality of measurements based on where the spots of light are received on the image detection plane 1104 and/or where the spots of light are not received on the image detection plane 1104 to determine three-dimensional shape information of the target. For example, the technique described in Watanabe, et al., "955-fps Real-time Shape Measurement of a Moving/Deforming Object using High-speed Vision for Numerous-point Analysis," 2007 IEEE International Conference on Robotics and Automation, Roma, Italy, 10-14 Apr. 2007 may be employed to determine the three-dimensional shape information.

An image is generated based on the three-dimensional shape information (block 1408). For example, the three-dimensional shape information may be formatted and/or processed to generate vector data, and the vector data is communicated to a surface system (e.g., the example electronics and processing unit 306 of FIG. 3, the example control unit 436 of the example coiled tubing system 402 of FIG. 4, the example surface system 725 of FIGS. 7 and 9, the example surface system 1222 of FIG. 12, and/or any other surface system) in real time. The example image generator 1230 may generate the image based on the vector data. In some examples, the image is displayed via the display 1232 to enable an operator to monitor downhole conditions and/or objects. For example, the image may be generated as the example downhole tool 700 is lowered past the borehole window 724, and the operator may determine and/or log a position, a condition, a size and/or any other characteristic of the borehole window 724.

The downhole tool is controlled based on the image (block 1410). For example, an operator of the downhole tool 700 may operate the example bent sub 900 to move the downhole tool 700 from the first borehole 720 through the window 724 and into the second borehole 722 by orienting the bent sub 900 such that an optical field of view of the second imaging system 704 is substantially centered relative to the window 724 using the image generated via the first imaging system 702 and/or an image generated via the second imaging system 704. In some examples, if corrosion and/or material buildup on and/or near the window 724 is detected based on the image generated via the first imaging system 702 and/or the second imaging system 704, treatment fluid is projected toward and/or near the window 724 to remove and/or reduce the corrosion and/or material buildup. In other examples, the downhole tool 700 is operated in other ways based on the image(s). The example method 1400 then returns to block 1402.

FIG. 15 is a flowchart representative of another example method 1500 disclosed herein. The example method 1500 begins by determining three-dimensional shape information of a target via an imaging system (block 1502). For example, the example imaging system 1100 of FIG. 11 may be employed on the logging tool 600 to determine three-dimensional information of a portion of a subterranean formation adjacent the logging tool 600. Shape characteristic data of the target is determined based on the three-dimensional shape information (block 1504). For example, texture, curvature, shape, size, and/or other shape characteristic of the portion of the subterranean formation may be determined based on the three-dimensional shape information and/or one or more images generated based on the three-dimensional shape information.

The shape characteristic data is associated with first predetermined target data stored in a database (block 1506). For example, the formatter 1210 may generate vector data based the shape characteristic data, and the database manager 1212 may match the vector data to predetermined target data such as, for example, texture data stored in the first database 1214 via spatial correlation. A database index associated with the first predetermined target data is determined (block 1508). For example, the first predetermined target data stored in the first database 1214 may be assigned one of a plurality of database indexes (e.g., letters, numbers and/or other designation), and the database manager 1212 determines which one of the databases indexes is assigned to the first predetermined target information.

The database index is communicated to a receiver at or near a surface of Earth (block 1510). For example, the database index may be communicated via the telemetry system 1226 to a receiver (e.g., the transceiver hub 438 of the coiled tubing reel 410) of the surface system 1222. In some examples, the three-dimensional shape information and/or the shape characteristic data is stored in the first database 1214, and the database index is communicated to the receiver via a low bandwidth telemetry link such as, for example, a mud pulse telemetry link.

Second predetermined target information is retrieved from a second database using the database index (block 1512). For example, the second database 1224 may be organized using the same or similar database indexes as the example first database 1214. Thus, the example data manager 1228 of the example surface system 1222 may use the database index communicated from the example imaging system 1200 to retrieve second predetermined target data from the second database 1224 that is assigned and/or associated with the database index and different that the first predetermined target data. In some examples, the retrieved predetermined target data includes, for example, information related to a subterranean formation (e.g., a composition of a portion of the subterranean formation), information related a borehole window (e.g., a size of the borehole window, mapping information of a lateral borehole defining the borehole window, identification of corrosion and/or material buildup), a condition of a target (e.g., presence of cracks, perforations, wear, etc. of a casing) and/or any other information. In some examples, the predetermined target information is presented in real-time to an operator of the downhole tool. Thus, the operator may be presented with information related to objects detected downhole via the imaging system 1200.

Figure 16:
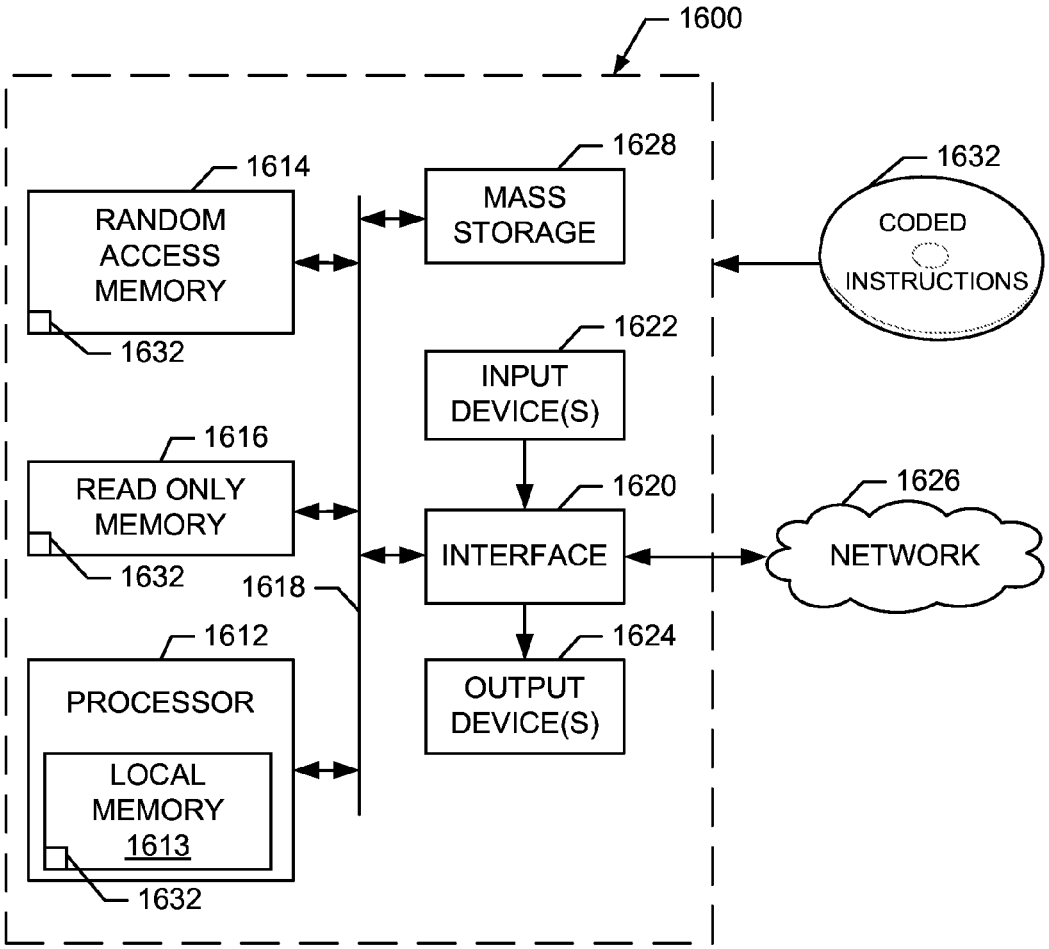
FIG. 16 illustrates an example processor platform that may be used and/or programmed to implement at least some of the example methods and apparatus disclosed herein.

FIG. 16 is a block diagram of an example processor platform 1000 capable of executing instructions to implement the example methods 1300 1400, 1500 of FIGS. 13-15 to implement the example the example imaging system 502 of FIGS. 5-6, the example first imaging system 702 of FIG. 7, the example second imaging system 704 of FIG. 7, the example imaging system 1100 of FIG. 11, and/or the example imaging system 1200 of FIG. 12. The processor platform 1000 can be, for example, a server, a personal computer, a mobile device (e.g., a cell phone, a smart phone, a tablet such as an iPad™), a personal digital assistant (PDA), an Internet appliance, a DVD player, a CD player, a digital video recorder, a Blu-ray player, or any other type of computing device.

The processor platform 1600 of the illustrated example includes a processor 1612. The processor 1012 of the illustrated example is hardware. For example, the processor 1612 can be implemented by one or more integrated circuits, logic circuits, microprocessors or controllers from any desired family or manufacturer.

The processor 1612 of the illustrated example includes a local memory 1613 (e.g., a cache). The processor 1612 of the illustrated example is in communication with a main memory including a volatile memory 1614 and a non-volatile memory 1616 via a bus 1618. The volatile memory 1614 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1616 may be implemented by flash memory and/or any other desired type of memory device. Access to the main memory 1614, 1616 is controlled by a memory controller.

The processor platform 1600 of the illustrated example also includes an interface circuit 1620. The interface circuit 1620 may be implemented by any type of interface standard, such as an Ethernet interface, a universal serial bus (USB), and/or a PCI express interface.

In the illustrated example, one or more input devices 1622 are connected to the interface circuit 1620. The input device(s) 1622 permit(s) a user to enter data and commands into the processor 1012. The input device(s) can be implemented by, for example, an audio sensor, a microphone, a camera (still or video), an image detection plane, a keyboard, a button, a mouse, a touchscreen, a track-pad, a trackball, isopoint and/or a voice recognition system.

One or more output devices 1624 are also connected to the interface circuit 1620 of the illustrated example. The output devices 1024 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 1620 of the illustrated example, thus, may includes a graphics driver card, a graphics driver chip or a graphics driver processor.

The interface circuit 1620 of the illustrated example also includes a communication device such as a transmitter, a receiver, a transceiver, a modem and/or network interface card to facilitate exchange of data with external machines (e.g., computing devices of any kind) via a network 1626 (e.g., an Ethernet connection, a digital subscriber line (DSL), a telephone line, coaxial cable, a cellular telephone system, etc.).

The processor platform 1600 of the illustrated example also includes one or more mass storage devices 1628 for storing software and/or data. Examples of such mass storage devices 1628 include floppy disk drives, hard drive disks, compact disk drives, Blu-ray disk drives, RAID systems, and digital versatile disk (DVD) drives.

The coded instructions 1632 of FIGS. 16 may be stored in the mass storage device 1628, in the volatile memory 1614, in the non-volatile memory 1616, and/or on a removable tangible computer readable storage medium such as a CD or DVD.

From the foregoing, it will be appreciated that the above disclosed methods, apparatus and articles of manufacture enable three-dimensional shape information to be determined and/or used to monitor downhole objects and/or conditions substantially in real-time. Some examples disclosed herein enable real-time communication of the three-dimensional shape information acquired downhole to a surface system. As a result, image generation and, thus, image monitoring and/or analysis may be performed uphole and/or at the surface system in real-time. In some examples, the three-dimensional shape information is used to control operation of a downhole tool. Some examples disclosed herein employ a downhole database and an uphole database to enable uphole retrieval and/or presentation of predetermined information related to a downhole target based on the three-dimensional shape information.

Although only a few examples have been described in detail above, those skilled in the art will readily appreciate that many modifications are possible in the examples without materially departing from this disclosure. Accordingly, such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

projecting flushing fluid into an optical field of view of an imaging system disposed on a downhole tool;

directing a pattern of light, the pattern having a plurality of spots, onto a target in the optical field of view via at least one laser of a light source of the imaging system;

receiving light directed from the target by an image detection plane having a plurality of detectors;

determining three-dimensional shape information of the target based on the light directed from the target and received via the plurality of detectors by comparing differences between the pattern directed onto the target and a pattern of spots directed from the target onto the image detection plane;

determining a characteristic of the target based on the three-dimensional shape information; and performing dynamic modification of a search area containing the target according to pattern changes.

2. The method of claim 1, wherein determining the characteristic of the target comprises determining a three-dimensional pattern of the target.

3. The method of claim 1, wherein determining the characteristic of the target comprises detecting a borehole window.

4. The method of claim 1 further comprising generating an image of the target based on the three-dimensional shape information.

5. The method of claim 1, further comprising generating vector data based on the three-dimensional shape information.

6. The method of claim 5 further comprising matching the vector data to predetermined target data stored in a database.

7. The method of claim 6 further comprising determining a database index of the predetermined target data and retrieving additional target data from a second database using the database index.

8. The method of claim 1, wherein directing the pattern of light onto the target comprises directing light having a wavelength enabling the light to propagate through the flushing fluid.

9. The method of claim 5 further comprising communicating the vector data toward a surface of the Earth substantially in real-time.

10. A method, comprising:

projecting flushing fluid from a flushing system located in a drill bit of a downhole tool such that flushing fluid flows into a field of view of an imaging system disposed on the drill bit, the imaging system including a light source and an image detection plane;

determining three-dimensional shape information of a target via a processor of the imaging system based on comparing differences between a first pattern of light directed onto the target via the light source and a second pattern of light received by the image detection plane, the second pattern being different from the first pattern due to the three-dimensional shape of the target; and generating an image based on the three-dimensional shape information; and controlling the downhole tool based on the image.

11. The method of claim 10, wherein controlling the downhole tool comprises controlling movement of a portion of the downhole tool to enable the portion of the downhole tool to move from a first borehole to a second borehole in communication with the first borehole.

12. The method of claim 11, wherein controlling the downhole tool comprises moving the portion of the downhole tool to substantially align a field of view of the imaging system with a center of the target, where the target is a window of the second borehole.

13. The method of claim 12 further comprising detecting the window of the second borehole via a second imaging system disposed on a side of the downhole tool, and wherein the imaging system is disposed on an end of the downhole tool.

14. The method of claim 11 further comprising determining an orientation of the portion of the downhole tool via an orientation sensor.

15. The method of claim 14 further comprising determining if the portion of the downhole tool is disposed in the second borehole based on the orientation of the portion of the downhole tool.

16. The method of claim 10, wherein controlling the downhole tool comprises directing treatment fluid from the downhole tool toward the target.

17. The method of claim 10 further comprising determining a three-dimensional pattern of the target based on the three-dimensional shape information and identifying the target based on the three-dimensional pattern.

18. A method, comprising:

determining three-dimensional shape information of a target in a borehole via an imaging system that projects a first pattern of light onto the target which in turn directs a second, altered pattern of light to a plurality of detectors;

determining shape characteristic data of the target based on the three-dimensional shape information via comparison of differences between the first pattern and the second pattern indicative of three-dimensional shape characteristics of the target;

matching the shape characteristic data with first predetermined target data stored in a first database;

determining a database index associated with the first predetermined target data;

communicating the database index from a position downhole in the borehole to a receiver proximate a surface of the Earth; and retrieving second predetermined target information from a second database using the database index once received at the surface.

19. The method of claim 18, wherein matching the shape characteristic data with the first predetermined shape characteristic data comprises:

generating vector data based on the shape characteristic data; and matching the vector data with the first predetermined target characteristic data via spatial correlation.

* * * * *